US010611516B2

(12) United States Patent
Herbeck et al.

(10) Patent No.: US 10,611,516 B2
(45) **Date of Patent: *Apr. 7, 2020**

(54) SUPPORT TRAY FOR FOLDABLY CONSTRUCTED PALLETS

(71) Applicant: Green Ox Pallet Technology, LLC, Centennial, CO (US)

(72) Inventors: Joshua Daniel Herbeck, Centennial, CO (US); Gregory D. Van de Mark, Centennial, CO (US)

(73) Assignee: GREEN OX PALLET TECHNOLOGY, LLC, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/279,177

(22) Filed: Feb. 19, 2019

(65) Prior Publication Data

US 2019/0177035 A1 Jun. 13, 2019

Related U.S. Application Data

(63) Continuation of application No. 15/575,272, filed as application No. PCT/US2016/033582 on May 20, 2016, now Pat. No. 10,246,219.

(Continued)

(51) Int. Cl.

| | |
|---|---|
| ***B65D 19/00*** | (2006.01) |
| ***B65D 19/20*** | (2006.01) |
| ***B65D 19/38*** | (2006.01) |

(52) U.S. Cl.

CPC ..... *B65D 19/0002* (2013.01); *B65D 19/0016* (2013.01); *B65D 19/20* (2013.01);

(Continued)

(58) Field of Classification Search

CPC ..... B65D 19/20; B65D 2519/00019; B65D 2519/00054; B65D 2519/00124; B65D 19/0002

(Continued)

(56) References Cited

U.S. PATENT DOCUMENTS

| | | | |
|---|---|---|---|
| 2,444,183 | A | 6/1948 | Cahners |
| 2,609,136 | A | 9/1952 | Sider |

(Continued)

FOREIGN PATENT DOCUMENTS

| | | | |
|---|---|---|---|
| DE | 7227035 | U | 10/1972 |
| FR | 2867161 | A1 | 9/2005 |

(Continued)

*Primary Examiner* — Jose V Chen

(74) *Attorney, Agent, or Firm* — Dorsey & Whitney LLP

(57) ABSTRACT

A foldably constructible support tray is provided for a foldably constructible pallet. The foldably constructible support tray may include a tray panel. The tray panel may include a pair of opposing lips foldably connected to opposing edges of the tray panel and a pair of opposing securing sidewalls foldably connected to the remaining opposing edges of the tray panel. Portions of each lip may be secured to each securing sidewall. The tray panel may be positioned on a support surface of a top member of the foldably constructible pallet. The foldably constructible pallet may include a bottom member connected to the top member. The bottom member may have a base. A peripheral wall may extend between the support surface and the base. A portion of the foldably constructible support tray may couple to the foldably constructible pallet to secure the foldably constructible support tray to the foldably constructible pallet.

20 Claims, 35 Drawing Sheets

Related U.S. Application Data

(60) Provisional application No. 62/164,749, filed on May 21, 2015.

(52) U.S. Cl.
CPC .... *B65D 19/38* (2013.01); *B65D 2519/00019* (2013.01); *B65D 2519/00024* (2013.01); *B65D 2519/00034* (2013.01); *B65D 2519/00054* (2013.01); *B65D 2519/00059* (2013.01); *B65D 2519/00069* (2013.01); *B65D 2519/00159* (2013.01); *B65D 2519/00164* (2013.01); *B65D 2519/00174* (2013.01); *B65D 2519/00273* (2013.01); *B65D 2519/00288* (2013.01); *B65D 2519/00318* (2013.01); *B65D 2519/00333* (2013.01); *B65D 2519/00497* (2013.01); *B65D 2519/00562* (2013.01); *B65D 2519/00567* (2013.01); *B65D 2519/00621* (2013.01); *B65D 2519/00666* (2013.01)

(58) Field of Classification Search
USPC ..... 108/51.3
See application file for complete search history.

(56) References Cited

U.S. PATENT DOCUMENTS

| | | | | |
|---|---|---|---|---|
| 3,026,015 | A * | 3/1962 | Severn | B65D 19/20 206/600 |
| 3,434,435 | A | 3/1969 | Achermann et al. | |
| 3,480,196 | A * | 11/1969 | De Simas | B65D 19/20 206/598 |
| 3,659,534 | A | 5/1972 | Childs | |
| 4,085,847 | A | 4/1978 | Jacalone | |
| 4,102,525 | A | 7/1978 | Albano | |
| 4,717,025 | A | 1/1988 | Maurer | |
| 4,864,940 | A | 9/1989 | Dunn | |
| 4,898,321 | A * | 2/1990 | Delany | B65D 19/20 108/51.3 |
| 5,176,090 | A | 1/1993 | Roberts et al. | |
| 5,285,732 | A | 2/1994 | Gottlieb | |
| 5,355,812 | A | 10/1994 | Kilpatrick et al. | |
| 5,377,600 | A | 1/1995 | Speese et al. | |
| 5,528,995 | A | 6/1996 | Lim | |
| 5,562,048 | A | 10/1996 | Gottlieb | |
| 5,704,487 | A * | 1/1998 | Taravella | B65D 19/20 108/51.3 |
| 5,881,652 | A | 3/1999 | Besaw | |
| 6,173,658 | B1 | 1/2001 | Moberg | |
| 7,426,890 | B2 | 9/2008 | Olvey | |
| 7,980,184 | B2 * | 7/2011 | Olvey | B65D 19/0012 108/51.3 |
| D808,608 | S | 1/2018 | Van De Mark et al. | |
| 2002/0069796 | A1 | 6/2002 | Olvey et al. | |
| 2004/0108434 | A1 | 6/2004 | Olvey | |
| 2005/0098067 | A1 | 5/2005 | Sketo | |
| 2006/0225626 | A1 | 10/2006 | Olvey et al. | |
| 2007/0068426 | A1 | 3/2007 | Teags et al. | |
| 2009/0308289 | A1 | 12/2009 | Ferguson | |
| 2011/0245059 | A1 | 10/2011 | Olvey et al. | |
| 2015/0239609 | A1 | 8/2015 | Olvey et al. | |
| 2018/0141703 | A1 * | 5/2018 | Herbeck | B65D 19/0016 |

FOREIGN PATENT DOCUMENTS

| | | |
|---|---|---|
| JP | 62174034 U1 | 11/1987 |
| JP | H0622232 U | 3/1994 |
| JP | 11301671 | 2/1999 |
| WO | 2011003126 A1 | 1/2011 |

* cited by examiner

SUPPORT TRAY FOR FOLDABLY CONSTRUCTED PALLETS

CROSS REFERENCE TO RELATED APPLICATIONS

This application is a continuation of U.S. patent application Ser. No. 15/575,272, filed 17 Nov. 2017, entitled "Foldably Constructed Force-Resisting Structure or Support," which is a national stage entry of International Patent Application No. PCT/US2016/033582, filed 20 May 2016, entitled "Foldably Constructed Force-Resisting Structure or Support," which claims priority under 35 U.S.C. § 119(e) to U.S. Provisional Application No. 62/164,749, filed 21 May 2015, entitled "Foldably Constructed Force-Resisting Structure or Support," all of which is hereby incorporated by reference in its entireties.

FIELD OF INVENTION

The present disclosure relates generally to a force-resisting structure or support, and more specifically to a force-resisting structure or support foldably constructed from one or more foldable blanks and especially suited for use as a pallet or dunnage support.

BACKGROUND

Pallets are primarily used to accommodate the bulk handling and transport of products and materials. Typically, a pallet comprises a flat, elevated top surface for supporting a load, such as goods, containers, or packages, a sufficient distance above the ground or floor so that the fork of a forklift can be inserted under the top surface in order to move the pallet with the entire load thereon from place to place. Traditionally, most pallets have been made from pieces of wood, specifically soft wood, assembled with metal fasteners such as nails or screws. However, a number of problems face present day users of conventional wooden pallets. The rising cost of making and repairing wooden pallets has detracted from the overall cost effectiveness of palletized shipments. Wooden pallets are heavy, bulky and cumbersome, and empty wooden pallets require substantial storage space. It is especially costly to transport empty wooden pallets by rail or truck for reuse.

Accordingly, a pallet constructed from a readily recyclable material, such as corrugated paperboard, is especially desirable. In warehouses and retail stores, separate receptacles are commonly provided for collecting, compacting and/or storing recyclable materials, such as paperboard and plastics. The recyclable materials can then be retrieved, and oftentimes sold, and recycled into new materials and/or products.

The present disclosure generally provides a foldably constructed force-resisting structure that addresses the above described problems and/or which more generally offers improvements or an alternative to existing arrangements.

BRIEF SUMMARY

The present disclosure generally provides a foldably constructed structure. In one embodiment, the foldably constructed structure may include a top blank including an interior surface, and a bottom blank including an exterior surface. The interior surface of the top blank may engage the exterior surface of the bottom blank to couple the top and bottom blanks together.

Embodiments of the present disclosure may include a bottom blank for a foldably constructed structure. The bottom blank may include an interior surface, an exterior surface, and at least one edge support. The at least one edge support may be defined by folding a portion of the bottom blank relative to the interior surface such that a portion of the exterior surface engages a portion of the interior surface to secure the at least one edge support in place.

Embodiments of the present disclosure may include a bottom member for a foldably constructed structure. The bottom member may include a bottom surface, an upper surface, and a plurality of support structures. Each of the support structures may be defined by folding a portion of the bottom member along at least two edges such that the bottom surface defines all exterior surfaces of each support structure.

Embodiments of the present disclosure may include a pallet. The pallet may include a top member and a bottom member operably connected to the top member. The bottom member may include a length, a width, and at least two edge portions folded along at least three fold lines extending the width of the bottom member to define at least two support columns extending the width of the bottom member.

Embodiments of the present disclosure may include a foldably constructed force-resisting structure. In one embodiment, the foldably constructed structure may include a first member and a second member, such as a top blank and a bottom blank, respectively. The first member may include a support panel and a plurality of peripherally spaced first supports foldably connected to the support panel. The second member may include a base panel and a plurality of peripherally spaced second supports foldably connected to the base panel. Each of the plurality of first supports may include a tab. Each of the plurality of second supports may include a slot. The tab of each of the plurality of first supports may be received within the slot of each of the plurality of second supports to secure the first member to the second member.

Embodiments of the present disclosure may include a foldably constructed support tray. In one embodiment, the support tray may include a tray panel, a pair of opposing lips foldably connected to the tray panel, a plurality of support flanges foldably connected to the pair of opposing lips, and a pair of opposing securing sidewalls foldably connected to the tray panel. The plurality of support flanges may be secured to the pair of securing sidewalls.

Embodiments of the present disclosure may include a foldably constructed pallet. In one embodiment, the pallet may include a top member and a bottom member connected to the top member. The top member may have a support surface and a first portion foldably connected to the support surface. The bottom member may have a base and a second portion foldably connected to the base. A peripheral wall may extend between the support surface and the base. The peripheral wall may be defined at least partially by the first portion of the top member and the second portion of the bottom member.

Embodiments of the present disclosure may include a foldably constructed support tray. The tray may be configured to be attached to a foldably constructed pallet. In one embodiment, the tray may include a tray panel. A pair of opposing lips may be foldably connected to the tray panel. A plurality of support flanges may be foldably connected to the pair of opposing lips. A pair of opposing securing sidewalls may be foldably connected to the tray panel. The plurality of support flanges may be secured to the pair of securing sidewalls. The pair of securing sidewalls may include a plurality of securing tabs for securing the tray to the foldably constructed pallet.

Embodiments of the present disclosure may include a force resisting structure. The force resisting structure may include a foldable pallet. The foldable pallet may include a top member having a support surface and a first portion foldably connected to the support surface. A bottom member may be connected to the top member. The bottom member may have a base and a second portion foldably connected to the base. A peripheral wall may extend between the support surface and the base. The peripheral wall may be defined at least partially by the first portion of the top member and the second portion of the bottom member. A foldable support tray may be coupled to the foldable pallet. The foldable support tray may include a tray panel. A pair of opposing lips may be foldably connected to the tray panel. A pair of securing sidewalls may be foldably connected to the tray panel. Portions of each lip may be secured to each securing sidewall. The tray panel may be positioned above the support surface.

Embodiments of the present disclosure may include a foldably constructed support tray. The foldably constructed support tray may be configured to be attached to a foldably constructed pallet. The tray may include a tray panel with first and second opposing edges. A pair of opposing lips may be foldably connected to the first opposing edges of the tray panel. A pair of opposing sidewalls may be foldably connected to the second opposing edges of the tray panel. Each sidewall may include an outer connecting member extending downwardly therefrom to a position below a bottom surface of the tray panel. The outer connecting members may be configured to secure the tray panel to the foldably constructed pallet.

Embodiments of the present disclosure may include a foldable support assembly or kit. The foldable support assembly may include a foldably constructible pallet in a first unfolded state. The foldably constructible pallet may include a first blank. The first blank may include predefined locations of weakness. The predefined locations of weakness may define a support panel, and a first portion foldably connected to the support panel. The first blank may be substantially flat in the first unfolded state. The foldably constructible pallet may include a second blank. The second blank may include predefined locations of weakness. The predefined locations of weakness may define a base panel, and a second portion foldably connected to the base panel. The second blank may be substantially flat in the first unfolded state. A foldably constructible support tray may be included in a second unfolded state. The foldably constructible support tray may include a tray blank. The tray blank may include predefined locations of weakness. The predefined locations of weakness may define a tray panel, a pair of opposing sidewalls foldably connected to the tray panel, and a pair of opposing lips foldably connected to the tray panel. Portions of each lip may secure to each sidewall when the tray blank is in a folded state. The first and second unfolded states may create a reduced volume for transportation.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings, which are incorporated into and constitute a part of the specification, illustrate examples of the disclosure and, together with the general description given above and the detailed description give below, serve to explain the principles of these examples.

DETAILED DESCRIPTION

The present disclosure generally provides a foldably constructed force-resisting structure. The force-resisting structure, which may be referred to as a pallet, can be used in a variety of applications, for example, in accommodating the mechanized bulk handling and transport of products and materials. The force-resisting structure, may be made of paperboard, cardboard, plastics, or other corrugated or cellular structured materials may be more readily recyclable or disposable compared to conventional wooden pallets and includes a lightweight and rigid structure that can support heavy loads (e.g., 2500-3500 lbs.). Because the force-resisting structure is foldably constructed, the force-resisting structure may be transported from a first location in a first configuration (e.g., unfolded or reduced volume) and assembled at a second location into a second configuration (e.g., folded or increased volume). In this manner, shipping costs associated with delivering the force-resisting structure to certain locations are significantly reduced compared to conventional wooden pallets. Compared to conventional wooden pallets, the present disclosure generally provides a force-resisting structure that is lighter in weight, strong, is easy to assemble, is easier and less costly to transport and store, requires less space for storage, is more readily recyclable or disposable, and minimizes environmental impact, among others.

In some embodiments of the present disclosure, the pallet includes a bottom blank folded multiple times along at least two edges to define two or more rolled or box-formed support structures. In a preferred embodiment, the support structures extend along the width or length of the pallet. Once folded, each support structure is held in place by being secured to locking tabs formed on an interior of the bottom blank. Once secured in place, and the support structures can are used to secure the top blank to the bottom blank, such as locking tabs of the top blank received within slots defined within the support structures of the bottom blank. Such a structure provides increased structural support for the pallet compared to conventional methods. Additionally or alternatively, because the support structures include multiple walls, all defined by the same edge portion or integrally formed section of material, the folding structure strengths the pallet by providing increased torsional and/or compressive strength and rigidity. For example, the rolled or box-formed support structures may evenly distribute a load over a large surface area of the pallet, which may increase the load limit of the assembled pallet over conventional structures. Moreover, the rolled or box-formed support structures may provide a large, stable base onto which a top blank of the pallet is supported, which may be desirable to limit the top blank from excessively sagging when a load is received thereon.

First Embodiment

Figure 1:
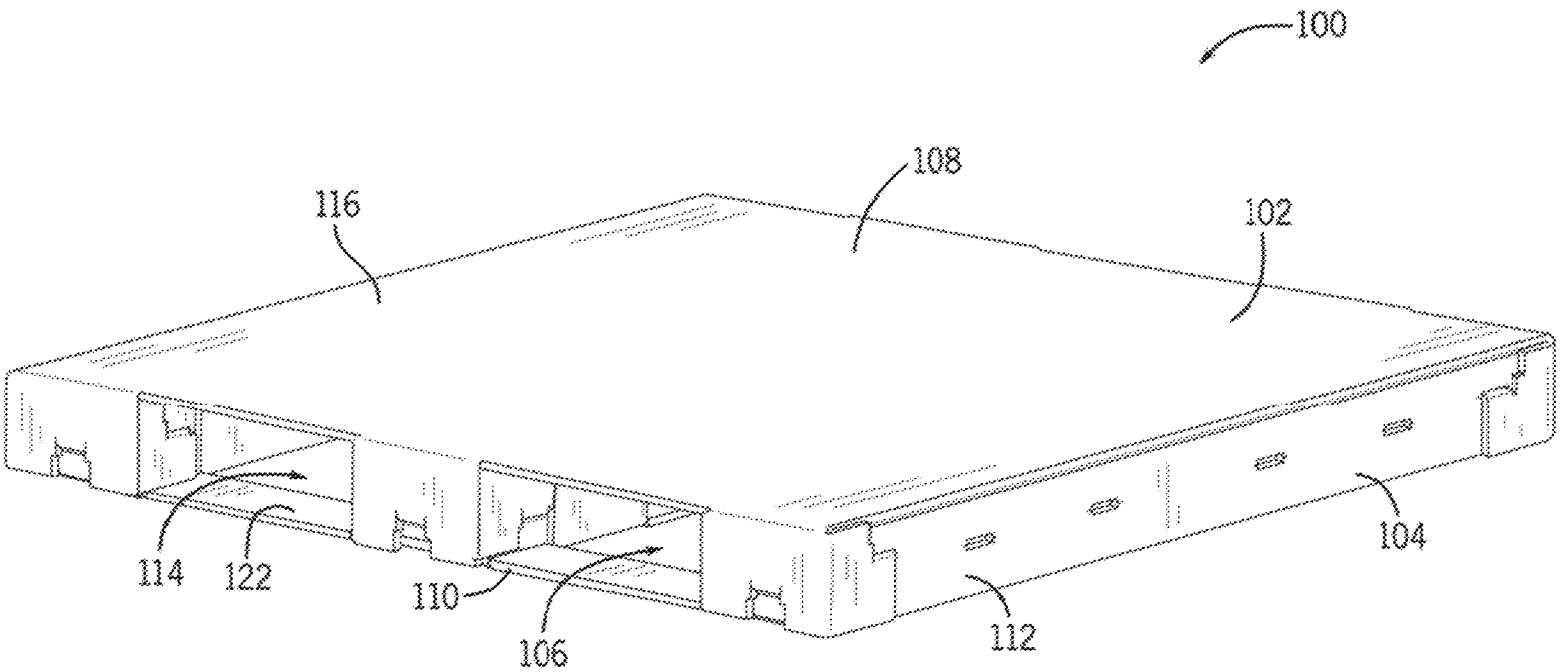
FIG. 1 is a top isometric view of a first embodiment of a force-resisting structure in accordance with an embodiment of the present disclosure.
Figure 2:
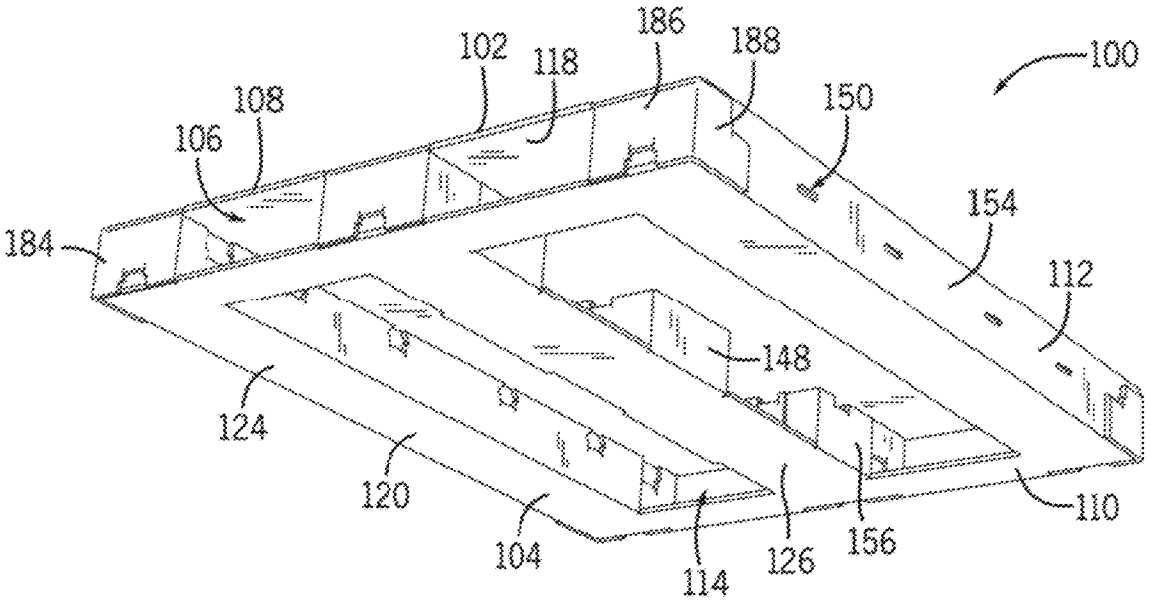
FIG. 2 is a bottom isometric view of the force-resisting structure of FIG. 1 in accordance with an embodiment of the present disclosure.

Referring to FIGS. 1 and 2, a foldably constructed, force-resisting structure 100 includes a first member 102 (e.g., a top member or blank) and a second member 104 (e.g., a bottom member or blank) connected to the first member 102. As explained below, the force-resisting structure 100, which may be referred to as a support structure or pallet, is constructed or assembled by folding and/or interlocking portions of the first and second members 102, 104 together. Once assembled, the force-resisting structure 100 has a generally cuboid configuration with a plurality of fork passages 106 defined therein for lifting and/or moving the force-resisting structure 100 when loaded with shipping goods. In general, the force-resisting structure 100 includes a generally rectangular support panel 108 for receiving a load (e.g., shipping goods or containers), a generally rectangular base panel 110 for supporting the force-resisting structure 100 and the load against a load surface (e.g., a floor or rack), and a plurality of supports extending substantially between the support panel 108 and the base panel 110. The plurality of supports may collectively define a peripheral wall 112, with or without fork passages 106, of the force-resisting structure 100, the peripheral wall 112 extending substantially between the support panel 108 and the base panel 110. In some embodiments, the base panel 110 may define a plurality of lift apertures 114 operable to receive load rollers of a pallet jack, for example. As illustrated, the support panel 108 includes an exterior surface 116 (see FIG. 1) and an interior surface 118 (see FIG. 2), the interior surface 118 facing the second member 104. The base panel 110 also includes an exterior surface 120 (see FIG. 2) and an interior surface 122 (see FIG. 1), the interior surface 122 of the base panel 110 facing the first member 102. The base panel 110 includes an outer region 124 and a central region 126. Although generally shown and described as being rectangular, the support panel 108 and the base panel 110 may have substantially any polygon shape.

Figure 5:
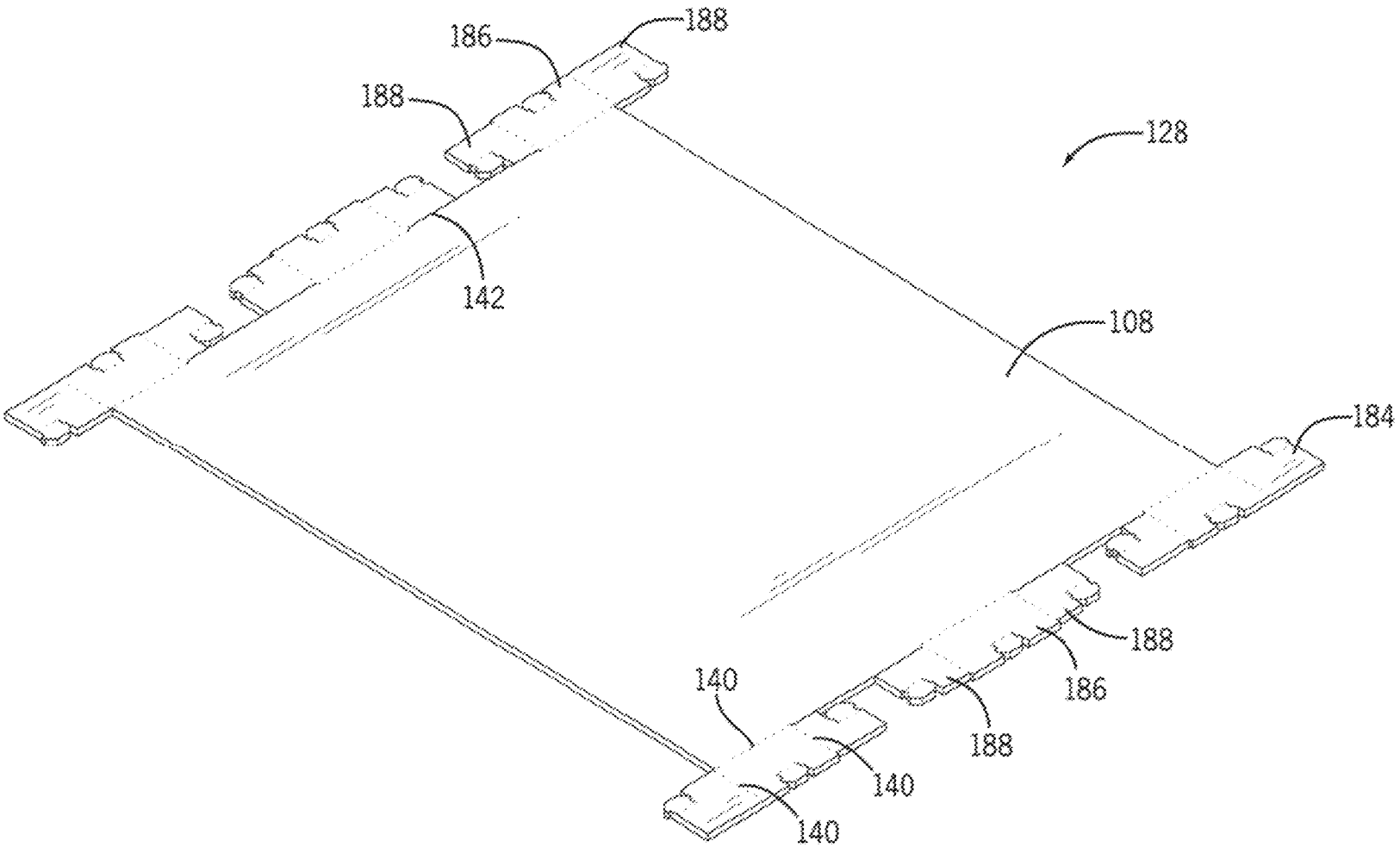
FIG. 5 is an isometric view of a first embodiment of a top blank in accordance with an embodiment of the present disclosure.
Figure 7:
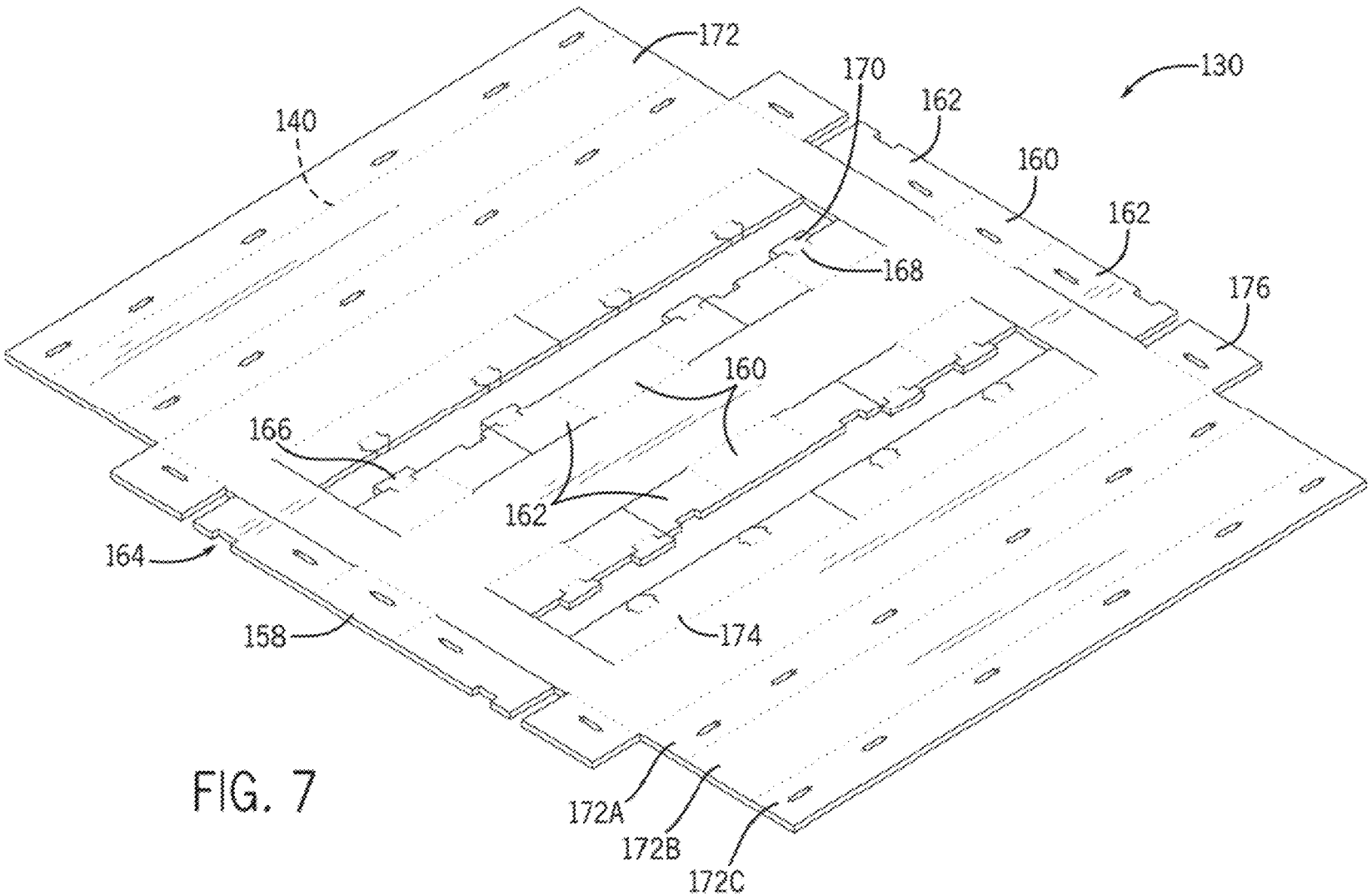
FIG. 7 is an isometric view of a first embodiment of a bottom blank in accordance with an embodiment of the present disclosure.

Referring to FIGS. 5 and 7, each of the first and second members 102, 104 is produced from a flat blank of sheet material that is foldably constructed or assembled. For instance, the first member 102 is produced from a first or top blank 128 (see FIG. 5), and the second member 104 is produced from a second or bottom blank 130 (see FIG. 7). Each of the first and second blanks 128, 130 may be formed monolithically as a single piece of sheet material. In an exemplary embodiment, the first and second blanks 128, 130 are each made from a corrugated or cellular material, such as corrugated paperboard 132 (see FIGS. 9A and 9B).

Figure 9A:
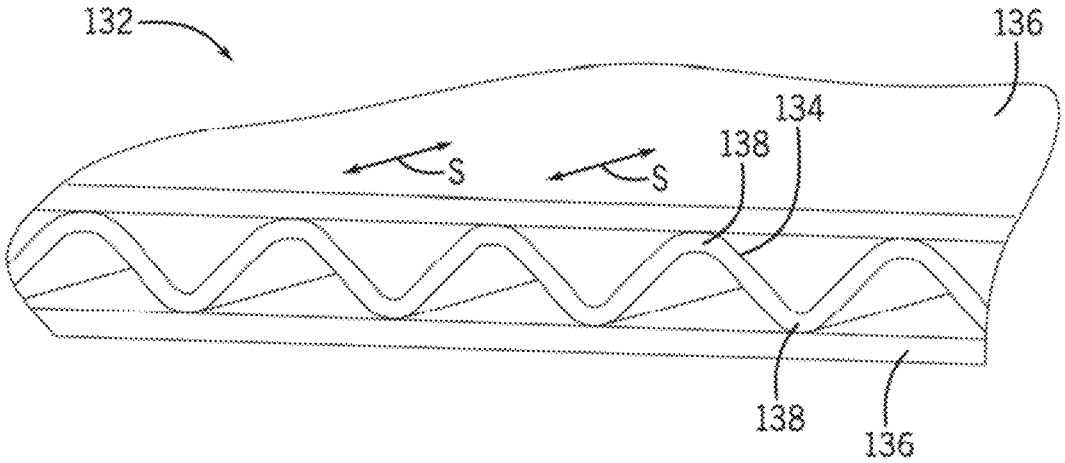
FIG. 9A is fragmentary cross-sectional view of a corrugated material including a single wall board in accordance with an embodiment of the present disclosure.
Figure 9B:
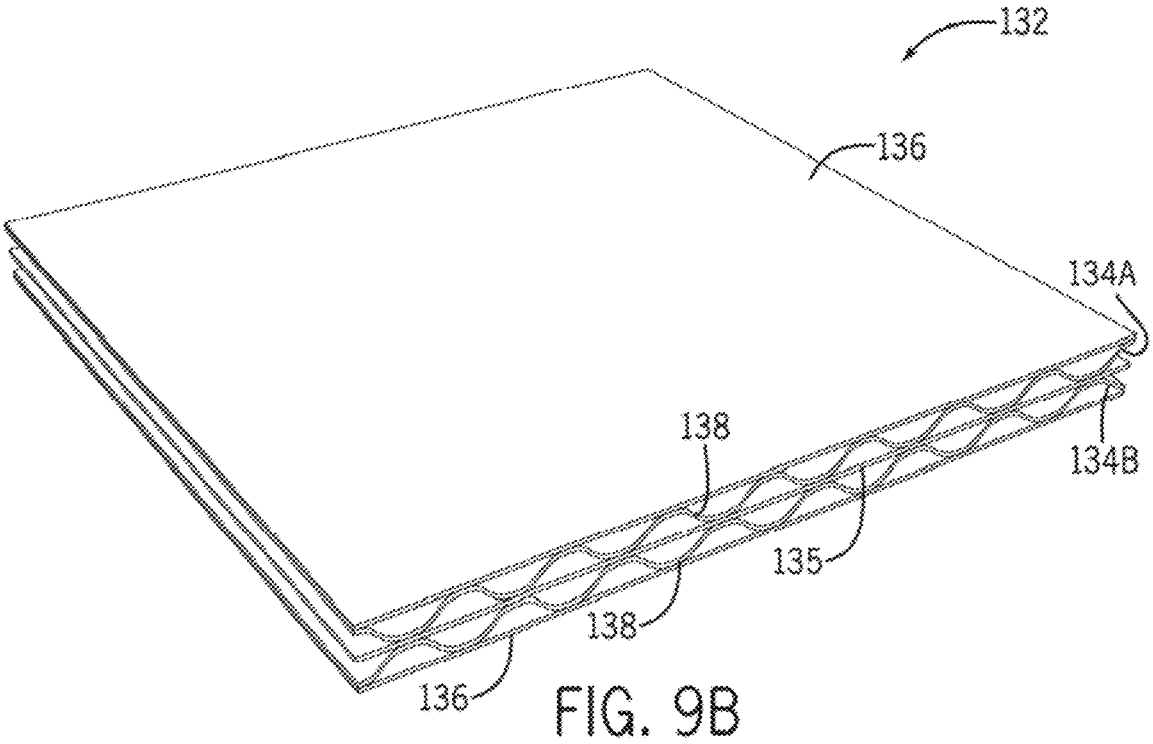
FIG. 9B is a fragmentary cross-sectional view of a corrugated material including a double wall board in accordance with an embodiment of the present disclosure.

As illustrated in FIGS. 9A and 9B, in embodiments including corrugated paperboard 132, the corrugated paperboard 132 includes a corrugated medium 134 held or sandwiched between two liner sheets 136. The corrugated medium 134 is configured with flutes or pleats forming interconnecting and parallel arches 138. The arches 138, which may be glued to the liner sheets 136 in a uniform or non-uniform pattern, generally extend in one direction (e.g., a strength direction S). The corrugated paperboard 132 may be a single wall board (see FIG. 9A) or a double wall board (see FIG. 9B). As shown in FIG. 9B, in embodiments including a double wall board, the corrugated paperboard includes a first medium 134A and a second medium 134B separated by an intermediate sheet 135. In such embodiments, the fluting of the first medium 134A may be configured differently than the fluting of the second medium 134B (e.g., tighter). Additionally or alternatively, the first medium 134A may have a thickness greater than a thickness of the second medium 134B. Although FIGS. 9A and 9B illustrate single and double wall boards, respectively, it is contemplated that the first and second blanks 128, 130 may be constructed from corrugated paperboard 132 having any number of boards (e.g., up to a six wall board).

Although paperboard is one material, the first and second blanks 128, 130 may be made from substantially any type of deformable material, such as thermal plastics and ductile metals, with or without a cellular or internal corrugated structure. The blanks 128, 130 may be formed in any suitable manner, such as by die or stamp cutting, the method may be varied based on the materials used for the blanks. Additionally, in some embodiments, the first and second blanks 128, 130 may be treated in various ways such that the blanks are moisture, water, fire, and/or bacteria resistant.

Figure 6:
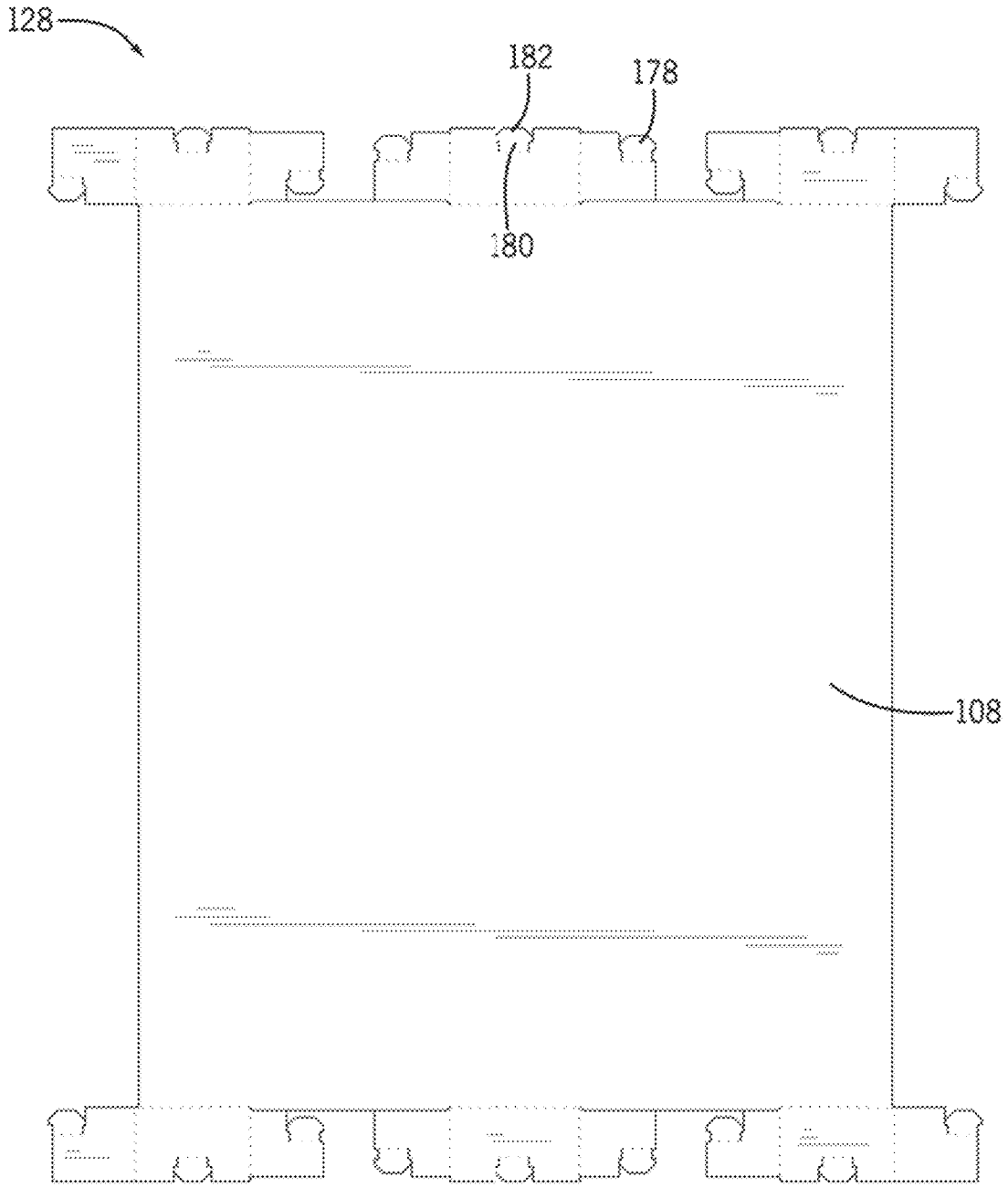
FIG. 6 is a top plan view of the top blank of FIG. 5 in accordance with an embodiment of the present disclosure.

Prior to being foldably constructed or assembled, the first and second members 102, 104 are substantially flat or planar, as represented by first and second blanks 128, 130, in FIGS. 5-7. When manufactured, the first and second blanks 128, 130 include a plurality of assembly features operable to facilitate assembly of the first member 102, the second member 104, and the force-resisting structure 100. For example, the first and second blanks 128, 130 are manufactured with a plurality of fold lines, cut lines, tabs, slots, slits, flanges, cutouts, and/or other predefined locations of weakness operable to facilitate assembly and provide strength to the first member 102, the second member 104, and/or the force-resisting structure 100, as described hereafter.

Examples of assembly features include the foldable portions of the first and second blanks 128, 130 foldable along fold lines 140 that are folded to construct the first and second members 102, 104, respectively (see FIGS. 5 and 7). For example, the first member 102 may include a first portion foldably connected to the support panel 108, and the second member 104 may include a second portion foldably connected to the base panel 110. In some embodiments, the first and second portions may connect to each other to at least partially define the peripheral wall 112 of the force-resisting structure 100.

As another example of an assembly feature, each of the first and second blanks 128, 130 is provided, where necessary, with cut lines 142 creating separable edges to define the foldable portions and/or other structural elements. Additionally or alternatively, the cut lines 142 may facilitate folding of the foldable portions by creating perforations or score lines along or adjacent the fold lines 140, as explained below. The cut lines 142 may extend entirely through the thickness of the blanks 128, 130, or in some embodiments, the cut lines 142 may extend only partially through the thickness of the blanks 128, 130 depending on the desired effect of the cut lines 142. For example, the cut lines 142 may create score lines on only one side of the blanks 128, 130 to facilitate folding of the foldable portions in one direction and in these embodiments the cut lines 142 do not extend through the entire thickness of the blanks. Similarly, partly severed edges may be formed that can be severed completely during foldable construction or assembly. As illustrated in FIGS. 5 and 7 for instance, the blanks 128, 130 include one or more cutout windows 144 to, for example, simplify assembly, reduce shipping weight, and/or increase functionality of the force-resisting structure 100. In some embodiments, the cutout windows 144, the fold lines 140, and/or the cut lines 142 may be defined or formed in the blanks 128, 130 during manufacturing, such as during die or stamp cutting.

Figure 3:
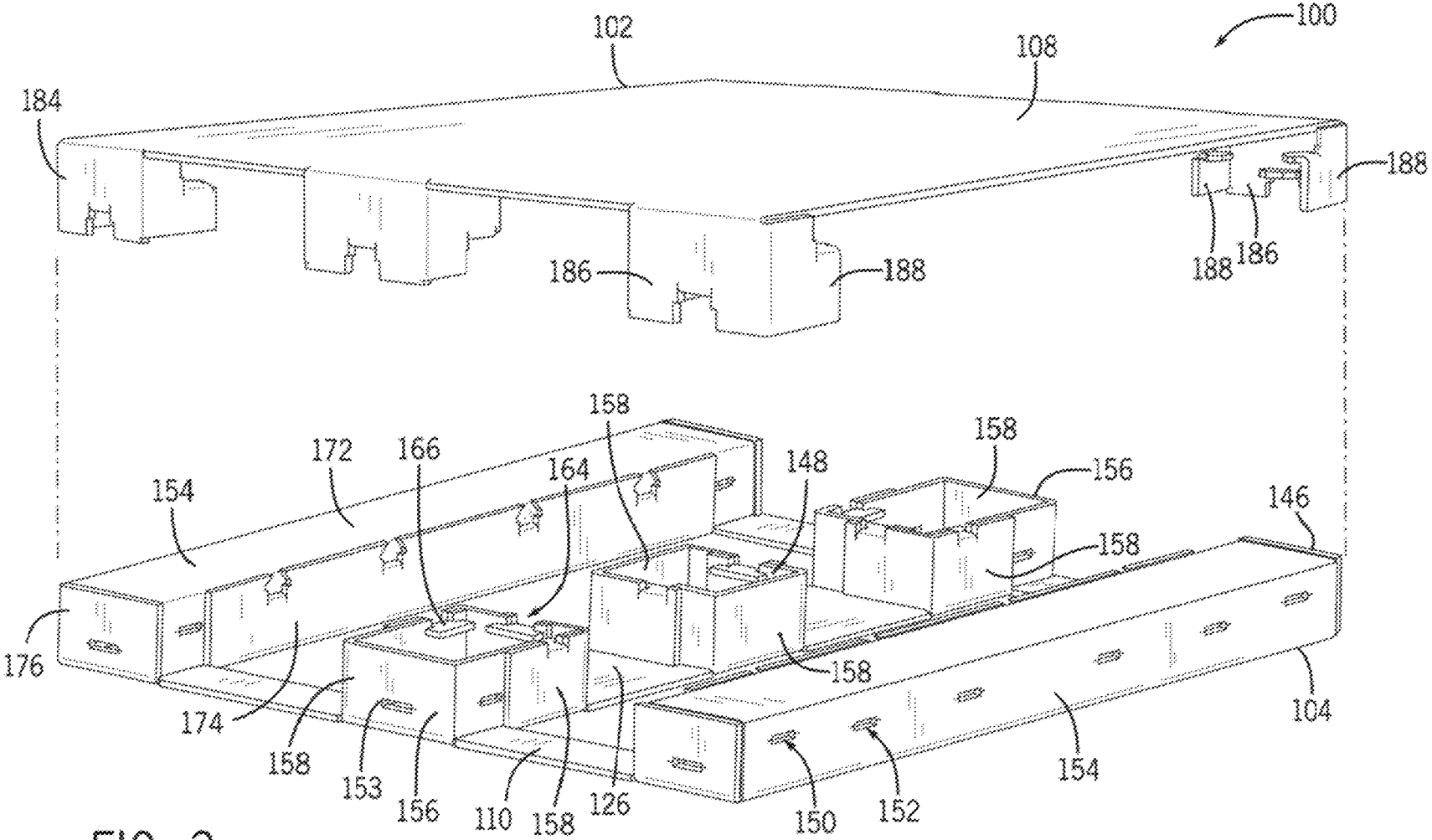
FIG. 3 is an exploded view of the force-resisting structure of FIG. 1 in accordance with an embodiment of the present disclosure.

With reference to FIG. 3, the second member 104 includes the base panel 110 and a plurality of peripherally spaced second supports 146 foldably connected to the base panel 110. A central pillar support 148 may be positioned within, and configured substantially equivalent to, the plurality of peripherally spaced second supports 146. In some embodiments, the central pillar support 148 is positioned generally concentric within the plurality of second supports 146 and is foldably connected to the central region 126 of the base panel 110. The central pillar support 148 may include a single support or may include two or more supports that act together to support the pallet. Additionally, the central pillar support 148 may extend a length and/or width of the pallet or may terminate prior thereto.

With reference to FIG. 3, in one embodiment the central pillar support 148 may include two or more support pillars 156 that are positioned on opposite sides the central pillar support 148, such as on a front and back, respectively, of the central pillar support 148. The support pillars 156 and the central pillar support 148 are foldably constructed from two or more pillar members 158 secured together. The pillar members 158 of the support pillars 156 are formed on the outer edge of the base panel 110, whereas the pillar members 158 of the central pillar support 148 are formed on an interior of the base panel 110.

Each pillar member 158 may include a main panel member 160 foldably connected to the base panel 110 and one or more side panel members 162 foldably connected to the main panel member 160. In such embodiments, the pillar members 158 are assembled by folding the main panel member 160 upward until the main panel member 160 is substantially perpendicular to the base panel 110. The side panel members 162 of each pillar member 158 are then folded horizontally towards the other pillar member 158 until the side panel members 162 are orthogonal to the main panel members 160.

To secure the pillar members 158 together, the pillar members 158 may include a plurality of open-topped cutouts 164 and a plurality of flanges 166 foldably received within the plurality of cutouts 164. For example, to secure the pillar members 158 together, the flange 166 of one pillar member 158 is foldably received within the cutout 164 of an adjacent pillar member 158. In a preferred embodiment, the flanges 166 are substantially T-shaped, and include a base portion 168 and a securing portion 170 attached together at right angles (see FIG. 8). The base portion 168, which may be foldably connected to the pillar members 158, may have a width smaller than a width of the securing portion 170. The width of the securing portion 170 may be greater than a width of the cutout 164. Accordingly, when the flange 166 is foldably received within the cutout 164, the excess width of the securing portion 170 causes a portion of the corrugated paperboard 132 adjacent the cutout 164 to at least partially fold in a securing direction (e.g., away from the foldable connection of the base portion 168 with the pillar member 158). In such embodiments, the partial folding of the corrugated paperboard 132 adjacent the cutout 164 reduces the likelihood of the flange 166 being foldably removed from the cutout 164, at least under typical forces seen under normal use.

The peripheral supports 146 or second supports are generally arranged on a perimeter of the base panel 110. For example, as shown in FIG. 3, the peripheral supports 146 may extend along an entire side of the base panel, e.g., along its entire length from a front side to a backside. As with the central support 148, the peripheral supports 146 may terminate prior to front and/or back side edges and/or may include multiple support elements that act together to support the pallet.

With reference to FIG. 3, each of the peripheral supports 146 includes a slot 150, and in an exemplary embodiment, a plurality of slots 150 (e.g., three slots), to connect the first member 102 to the second member 104. In some embodiments, at least one of the second supports 146 may include a plurality of accessory slots 152 to connect the force-resisting structure 100 to an accessory, such as a tray, as described below. Each of the slots 150 and accessory slots 152 may be substantially rectangular in shape having a width greater than a height. In some embodiments, a slit 153 may extend longitudinally from an end of the slots 150 and the tray slots 152 for purposes as explained hereafter. In some embodiments, each slot 150 and each tray slot 152 may extend perpendicular to the strength direction S of the corrugated paperboard 132, which provides enhanced strength for the joints as discussed below.

With continued reference to FIG. 3, the peripheral supports 146 may include two or more support walls 154 and once assembled, the support walls 154 may extend along a periphery of the force-resisting structure 100 (e.g., along a majority of a side of the force-resisting structure 100).

Figure 8:
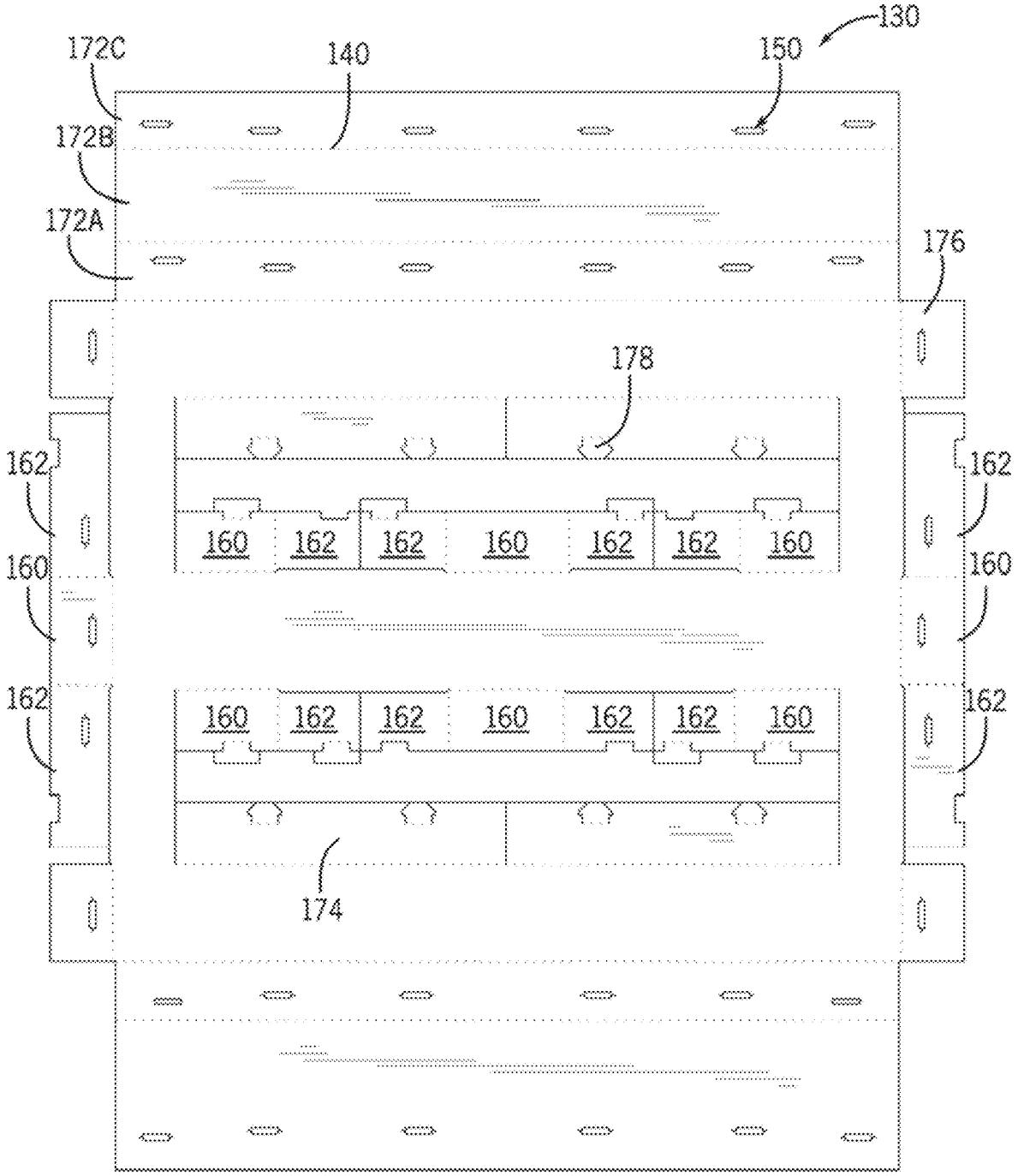
FIG. 8 is a top plan view of the bottom blank of FIG. 7 in accordance with an embodiment of the present disclosure.

With reference to FIGS. 3 and 8 each of the support walls 154 may be foldably constructed from three or more wall panels 172 and a securing panel 174 extending adjacent and secured to one of the three or more wall panels 172. For example, a first wall panel 172A may be foldably connected to the outer region 124 of the base panel 110, a second wall panel 1728 may be foldably connected to the first wall panel 172A, and a third wall panel 172C may be foldably connected to the second wall panel 1728. In some embodiments, a support cap 176, which may be foldably connected to the outer perimeter region 124 of the base panel 110, may be folded to at least partially cover an end of the support walls 154. The slots 150 and the accessory slots 152 are defined in at least one of the support cap 176, the first wall panel 172A, the second wall panel 1728, and/or the third wall panel 172C. As one example, the slots 150 are defined in the support cap 176 and in the first and third wall panels 172A, 172C.

The securing panel 174, which is foldably connected to the outer region 124 of the base panel 110, may include a plurality of tabs 178, each tab 178 having a base structure 180 and a generally triangular-shaped head 182 connected to the base structure 180 (see FIG. 8). Each tab 178 may be slidably received within one of the plurality of slots 150 defined within the third wall panel 172C. The base structure 180 of the tabs 178, which may be foldably connected to the securing panel 174, may have a width smaller than the width of a corresponding slot 150, and a length at least equal to the thickness of the second blank 130.

Each support wall 154 may be assembled by first folding the first wall panel 172A towards the first member 102 until the first wall panel 172A extends substantially perpendicular to the base panel 110. The second wall panel 1728 of each support wall 154 may then be folded inwardly until the first and second wall panels 172A, 172B are substantially perpendicular. The third wall panel 172C may then be folded towards the base panel 110 until the third wall panel 172C is substantially perpendicular to both the second wall panel 1728 and the base panel 110. The securing panel 174 may then be folded towards the first member 102 until the securing panel 174 extends substantially perpendicular to the base panel 110 and parallel to the third wall panel 172C. The tabs 178 of the securing panel 174 may then be inserted into the slots 150 defined in the third wall panel 172C. Finally, the support caps 176 are folded towards the first member 102 until the support caps 176 extend substantially perpendicular to the base panel 110.

Figure 10:
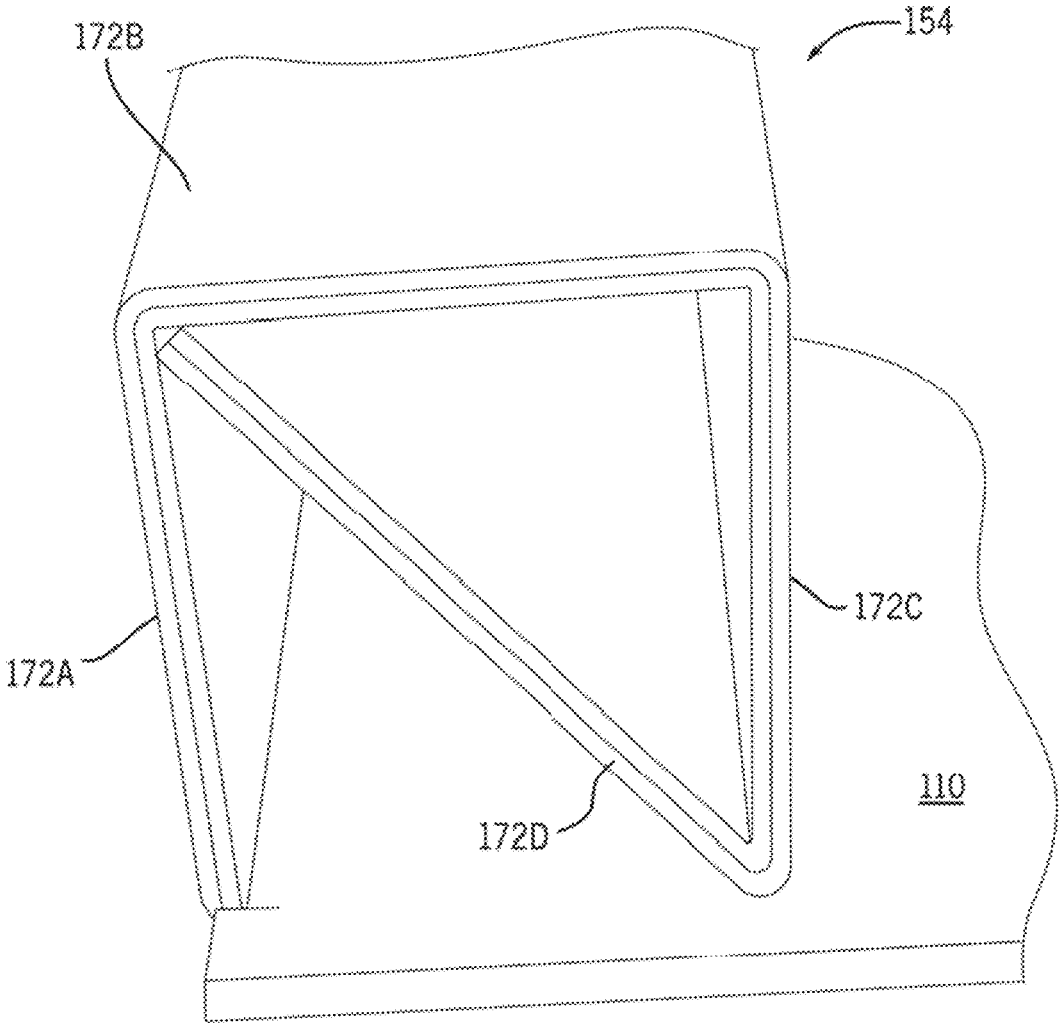
FIG. 10 is a cross-sectional view of a support wall in accordance with an embodiment of the present disclosure.
Figure 11:
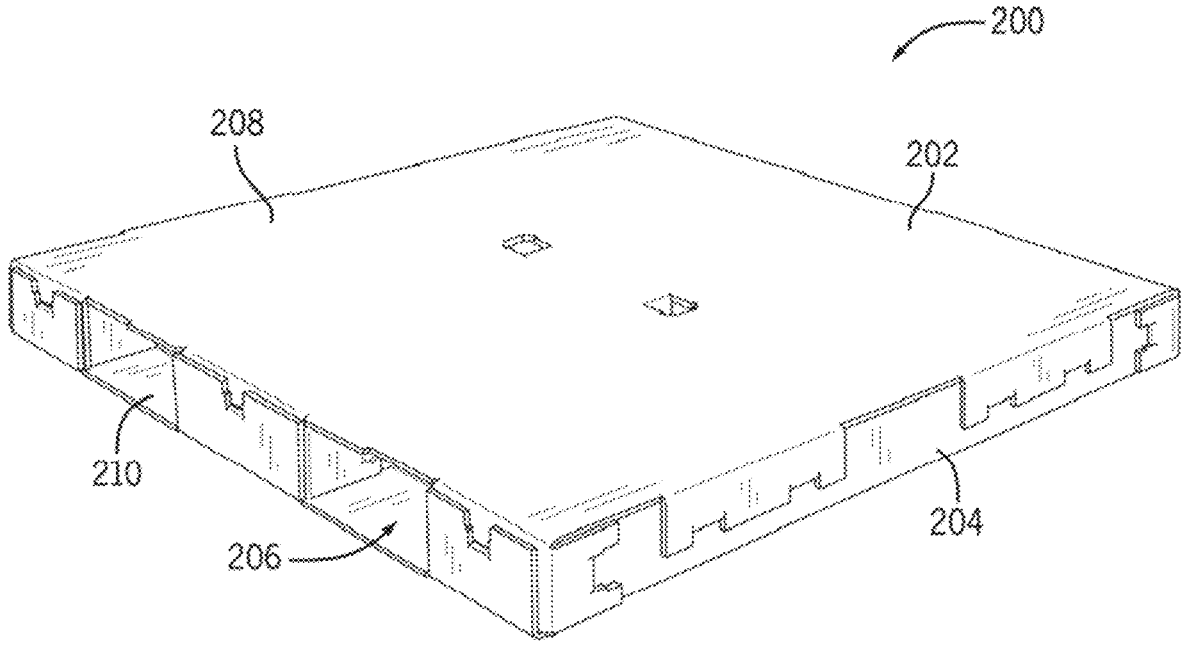
FIG. 11 is an isometric view of a second embodiment of a force-resisting structure in accordance with an embodiment of the present disclosure.
Figure 12:
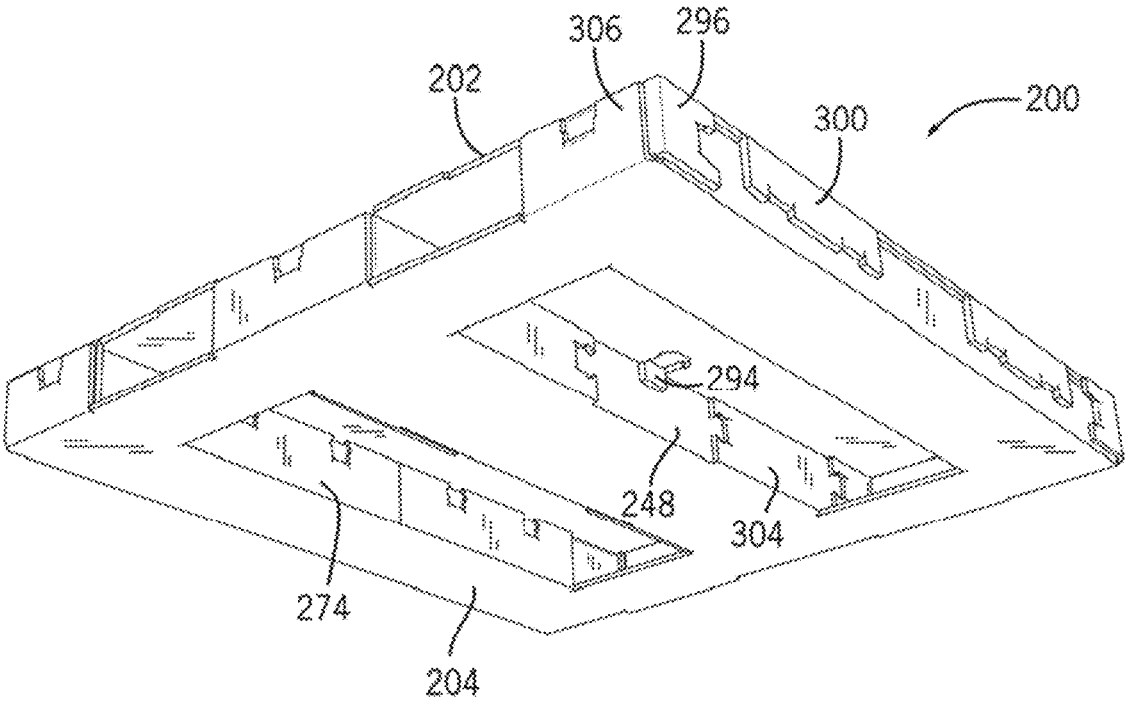
FIG. 12 is a bottom isometric view of the force-resisting structure of FIG. 11 in accordance with an embodiment of the present disclosure.

Once assembled, each support wall 154 of the peripheral supports 146 forms a generally cuboid structure. As shown in FIG. 3, each support wall 154 is a generally rectangular parallelepiped, although it is contemplated that the support walls 154 may have any suitable shape. In some embodiments, each support wall 154 may have a diagonally bisected rectangular cross-section (see FIG. 10) to substantially increase the load capacity of the support wall 154. In such embodiments, a fourth wall panel 172D is foldably connected to the third wall panel 172C and then folded at an angle vertically to bisect the cavity defined by the wall panels 172A, 1728, 172C.

Figure 4:
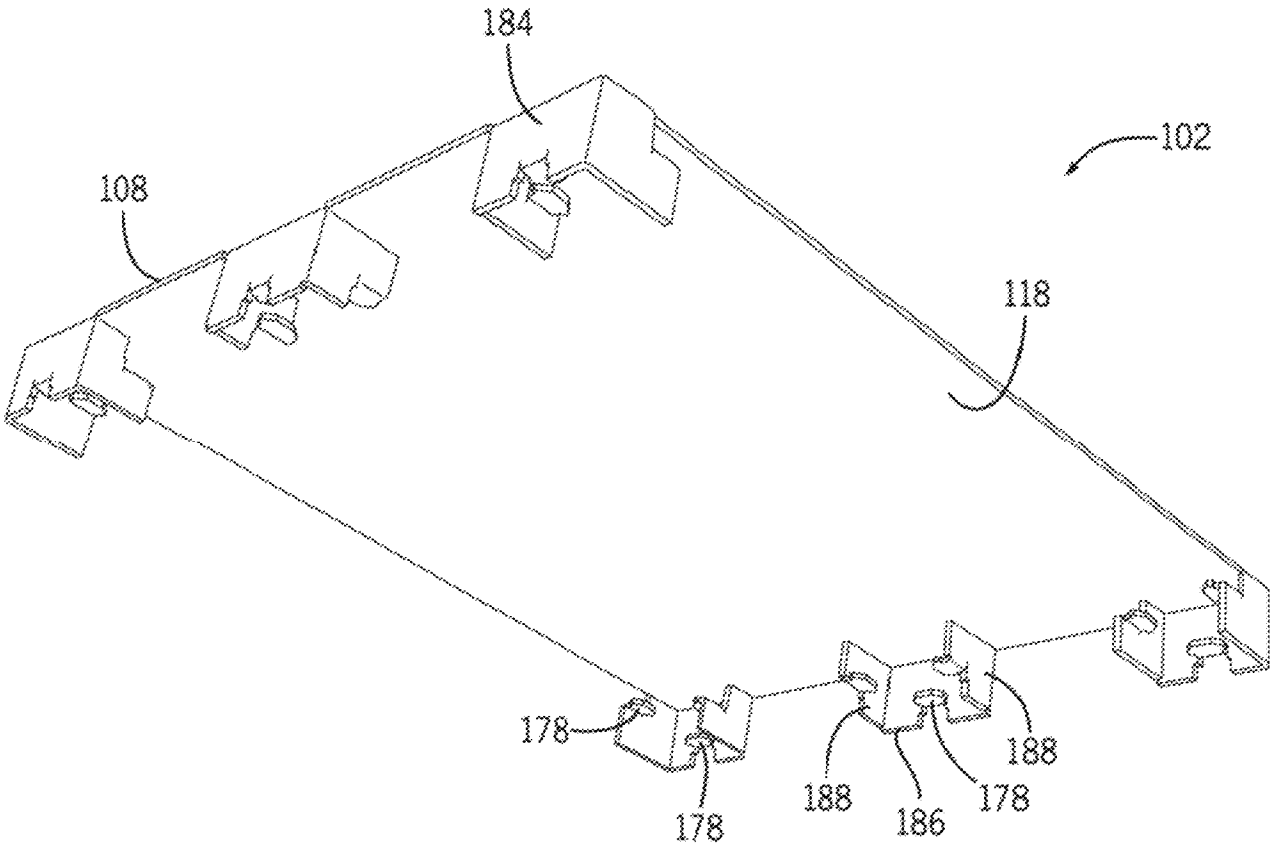
FIG. 4 is a bottom isometric view of a first embodiment of a first member in accordance with an embodiment of the present disclosure.

Referring now to FIGS. 3 and 4, the first member 102 includes the support panel 108 and a plurality of peripherally spaced first supports 184 foldably connected to the support panel 108 (e.g., an outer periphery). As best seen in FIG. 4, each of the first supports 184 may include a main panel 186 foldably connected to the support panel 108, one or more side panels 188 (e.g., two side panels 188) foldably connected to the main panel 186, and at least one tab 178 foldably connected to the main panel 186 and/or side panels 188.

In an exemplary embodiment, each first support includes a plurality of tabs 178 (e.g., three tabs 178). As shown in FIG. 6, each tab 178 includes a base structure 180 and a generally triangular-shaped head 182 connected to the base structure 180. The base structure 180 of the tabs 178, which may be foldably connected to the first supports 184, may have a width smaller than the width of the slot 150, and a length at least equal to the thickness of the second blank 130.

The first supports 184 are assembled by folding the main panel 186 vertically downward until the main panel 186 is substantially perpendicular to the support panel 108. The side panels 188 are then folded inwardly until each side panel 188 is substantially perpendicular to both the support panel 108 and the main panel 186. The tabs 178 are then folded inwardly until each tab 178 is substantially perpendicular to the main panel 186 and/or the side panel(s) 188.

With reference to FIG. 3, the force-resisting structure 100 is constructed by connecting the first member 102 to the second member 104. For example, the first member 102 may be positioned or otherwise placed on top of the second member 104 so the first and second supports 184, 146 are in aligned position. The first supports 184 may be connected to the support walls 154 and to the support pillars 156. With reference to FIG. 1, at least two of the first supports 184 may be connected to each of the support walls 154. As best seen in FIG. 2, the central pillar support 148 may reduce or mitigate sagging of the support panel 108 by supporting a central region 126 of the interior surface of the support panel 108.

To secure the first member 102 to the second member 104, each tab 178 of the first supports 184 is received within a corresponding slot 150 in the second supports 146. To secure the tab 178 within the slot 150, the leading portion 182 of the tab 178 may have a width greater than the width of the slot 150. In such embodiments, the slit 153 may accommodate for the extra width of the leading portion 182. In this manner, the slit 153 may reduce the force required to insert the tab 178 within the slot 150. Although the slit 153 facilitates receipt of the tab 178 within the slot 150, the slit 153 is sufficiently strong to reduce the likelihood of the tab 178 being pulled out of the slot 150, at least under typical forces seen under normal use. Once assembled, a top portion 190 of each of the first and second supports 184, 146 may abut and/or support the interior surface 118 of the support panel 108, and a bottom portion 192 of each of the first and second supports 184, 146 may abut and/or support the interior surface 122 of the base panel 110. As such, the first and second supports 184, 146 may extend substantially between the support panel 108 and the base panel 110.

Second Embodiment

FIGS. 11-17 illustrate another embodiment of a force-resisting structure 200. Similar to the force-resisting structure 100 discussed above, the force-resisting structure 200 includes a first member 202 (e.g., a top blank or member) and a second member 204 (e.g., a bottom blank or member) connected to the first member 202, each of the first and second members 202, 204 being foldably constructed or assembled. Each of the first and second members 202, 204 is produced from a flat blank of sheet material (e.g., a first or top blank 228 and a second or bottom blank 230, respectively) that is foldably constructed or assembled. When connected together, the first and second members 202, 204 define a generally cuboid structure operable to support a load received thereon. Together, the first and second members 202, 204 define a plurality of fork passages 206 for purposes as explained above.

Prior to being foldably constructed or assembled, the first and second members 202, 204 are substantially flat or planar, as represented by a first blank 228 (see FIG. 14) and a second blank 230 (see FIG. 16), respectively. Each of the first and second blanks 228, 230 may be formed monolithically as a single piece of sheet material having a cellular structure, such as corrugated paperboard (see FIGS. 9A and 9B and their associated description above). Like the blanks 128, 130 discussed above, the first and second blanks 228, 230 may be made from substantially any type of deformable material, such as thermal plastics and ductile metals, with or without a cellular or corrugated structure. The first and second blanks 228, 230 may be formed in any suitable manner, such as by die or stamp cutting, and may be treated in various ways such that the first and second blanks 228, 230 are moisture, water, fire, and/or bacteria resistant.

Figure 13:
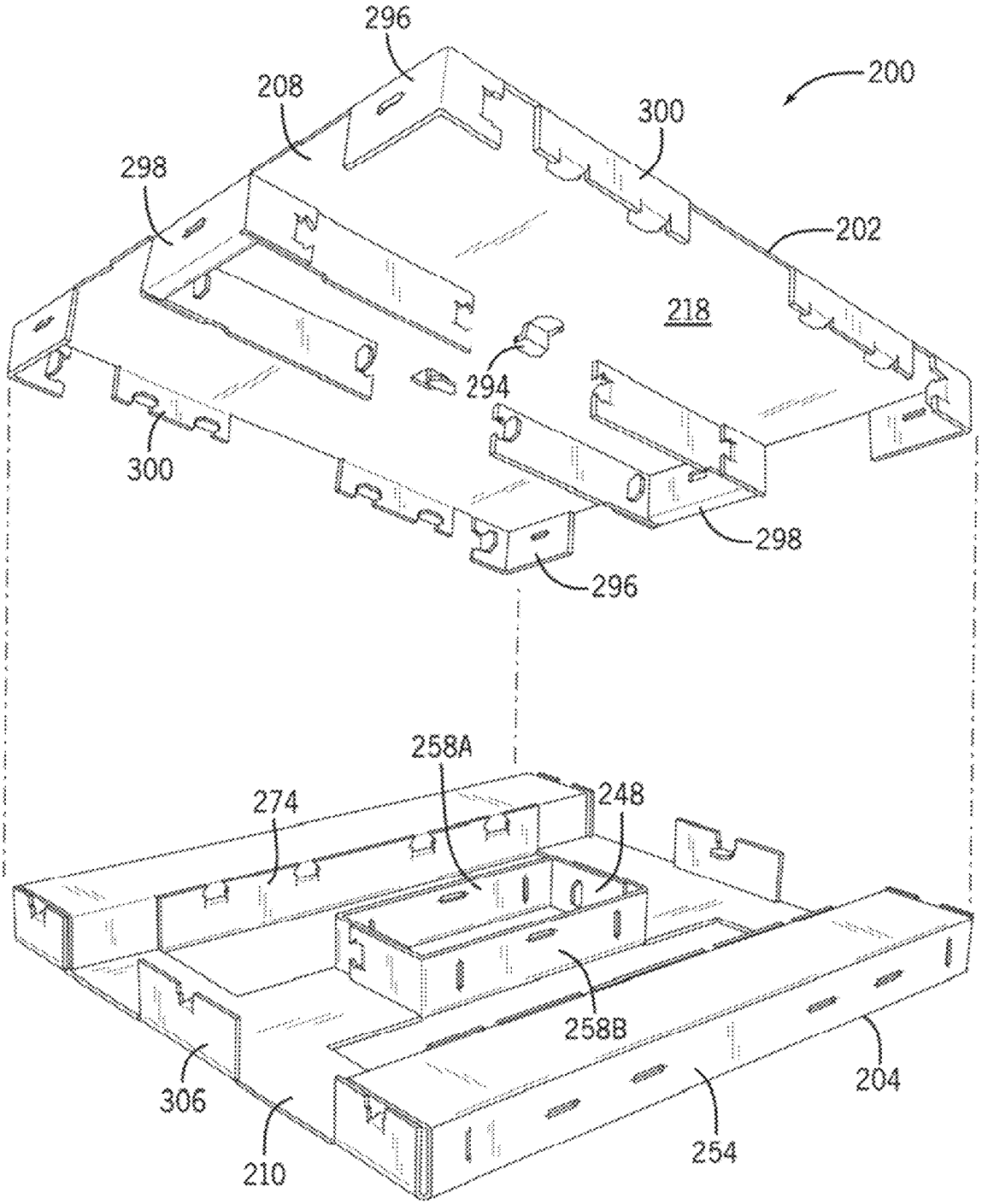
FIG. 13 is an exploded view of the force-resisting structure of FIG. 11 in accordance with an embodiment of the present disclosure.
Figure 14:
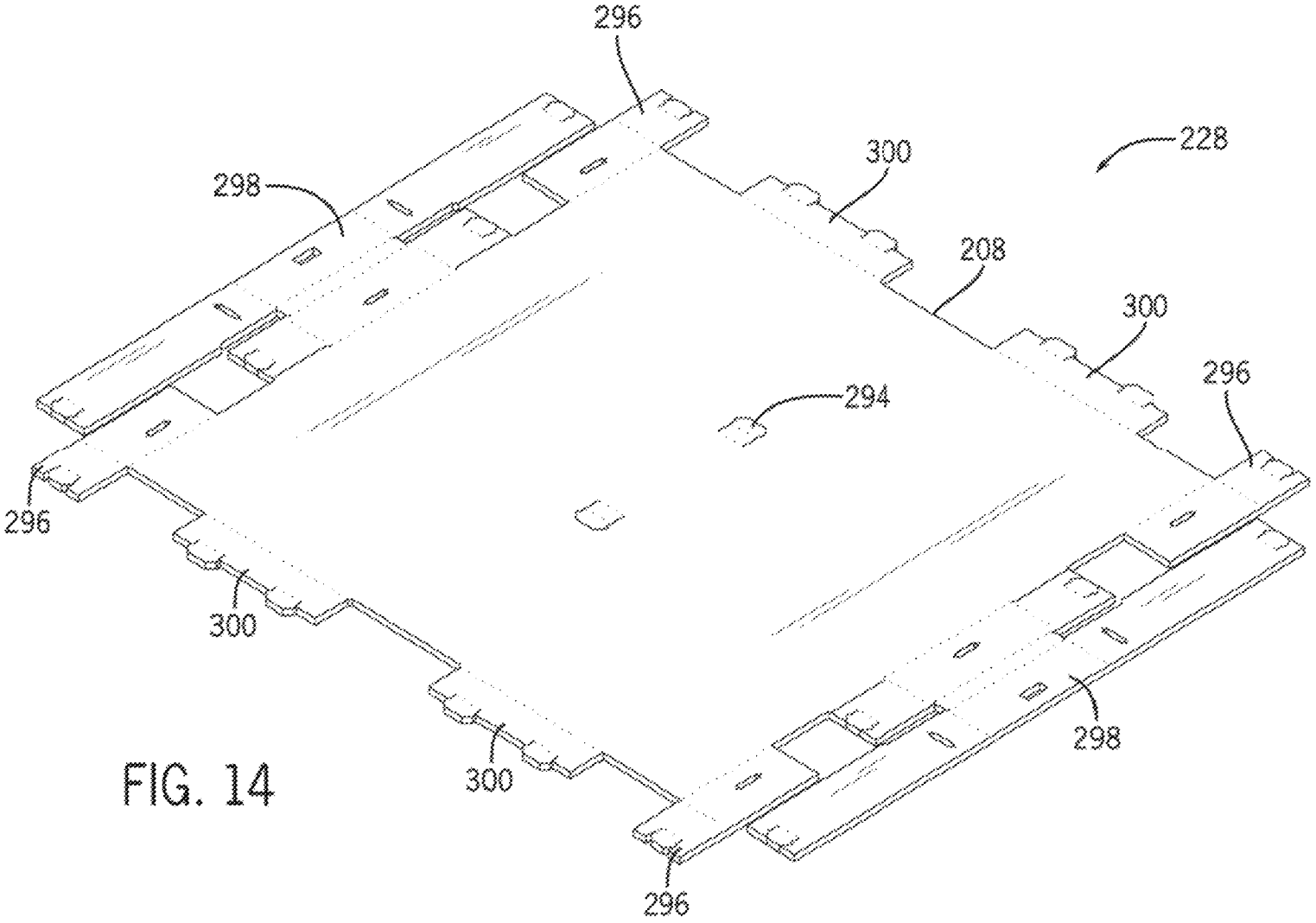
FIG. 14 is an isometric view of a second embodiment of a top blank in accordance with an embodiment of the present disclosure.

With reference to FIG. 13, the first member 202 includes a substantially planar support panel 208 and a lock mechanism 294 extending from an interior surface 218 of the support panel 208 and towards the second member 204. In some embodiments, the lock mechanism 294 may be a tab 278 foldably connected to the support panel 208. A plurality of peripherally spaced first supports 284 is foldably connected to an outer periphery of the support panel 208. The second member 204 includes a base panel 210 and a plurality of second supports 246 foldably connected to the base panel 210. Similar to the base panel 110 above, the base panel 210 is generally rectangular and includes an outer region 224 and a central region 226. As explained below, the first supports 284, the second supports 246, and the lock mechanism 294 provide structural rigidity to the force-resisting structure 200, and are operable to effectively lock the first member 202 and the second member 204 together. Similar to the force-resisting structure 100 described above, the base panel 210 includes a plurality of lift apertures 214 operable to receive, for example, load rollers of a pallet jack.

Figure 15:
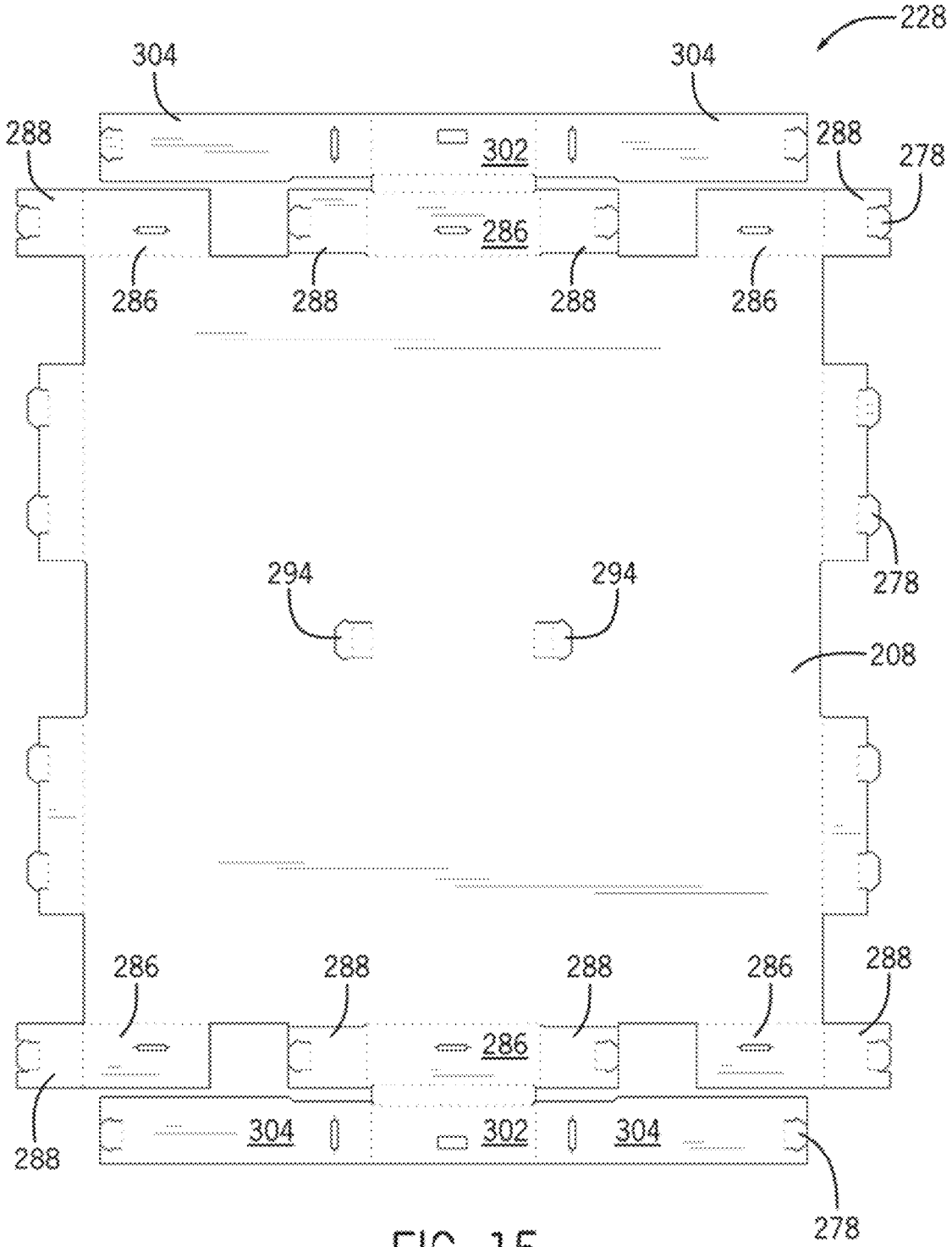
FIG. 15 is a top plan view of the top blank of FIG. 14 in accordance with an embodiment of the present disclosure.
Figure 16:
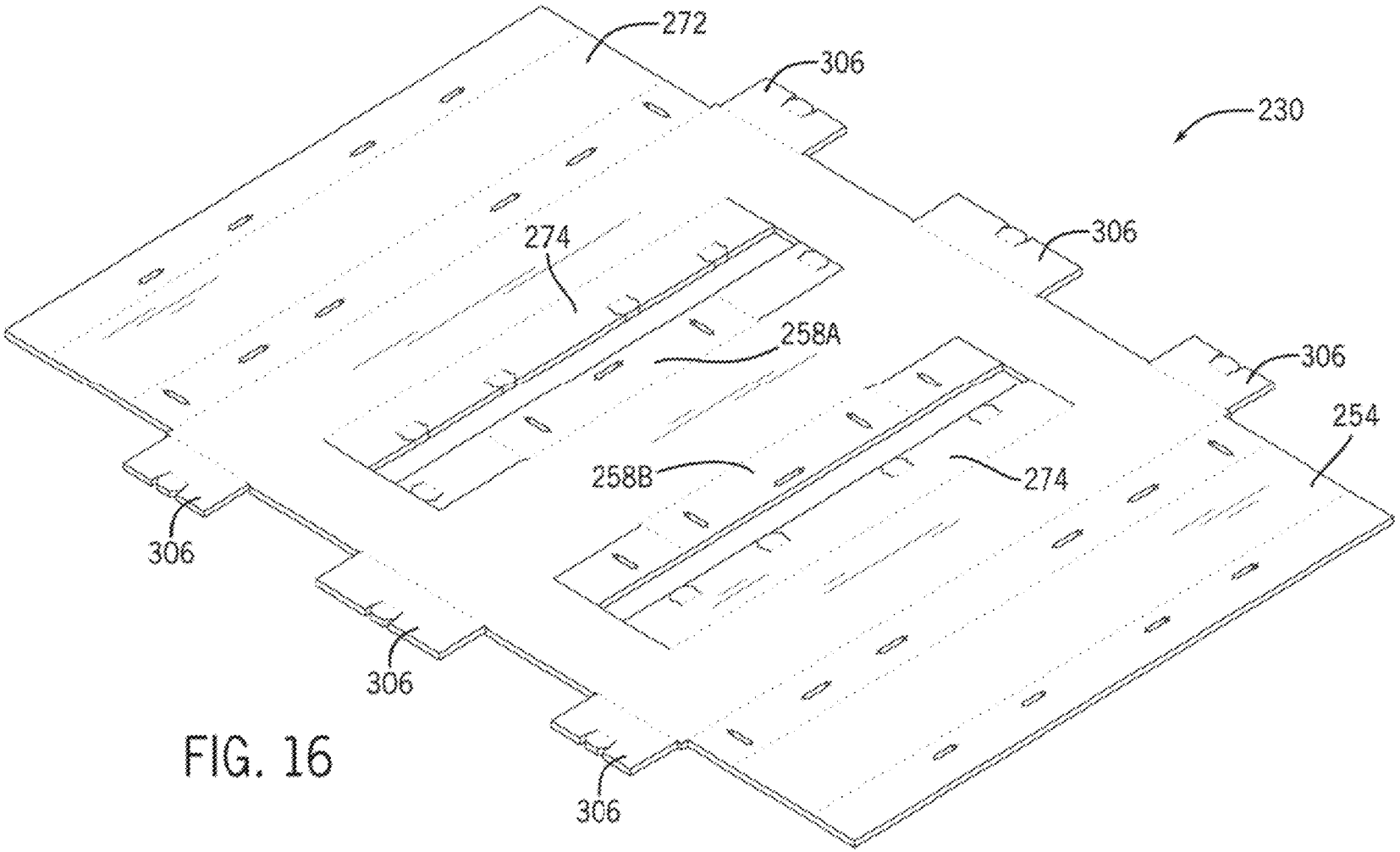
FIG. 16 is an isometric view of a second embodiment of a bottom blank in accordance with an embodiment of the present disclosure.

As shown in FIG. 13, the first supports 284 may include a plurality of corner supports 296, a plurality of first side supports 298, and a plurality of second side supports 300. Each of the corner supports 296, the first side supports 298, and the second side supports 300 includes a main panel 286 foldably connected to the support panel 208. The corner supports 296 and the first side supports 298 may also include at least one side panel 288 foldably connected to the main panel 286. In the exemplary embodiment shown in FIG. 13, the first side supports 298 include a secondary panel 302 foldably connected to the main panel 286, and a pair of panel extensions 304 foldably connected to the secondary panel 302. In some embodiments, each of the corner supports 296, the first side supports 298, and the second side supports 300 includes at least one tab 278 for purposes described below. As can be seen in FIG. 15, the tab 278 is configured substantially equivalent to the tabs 178 described above.

Figure 17:
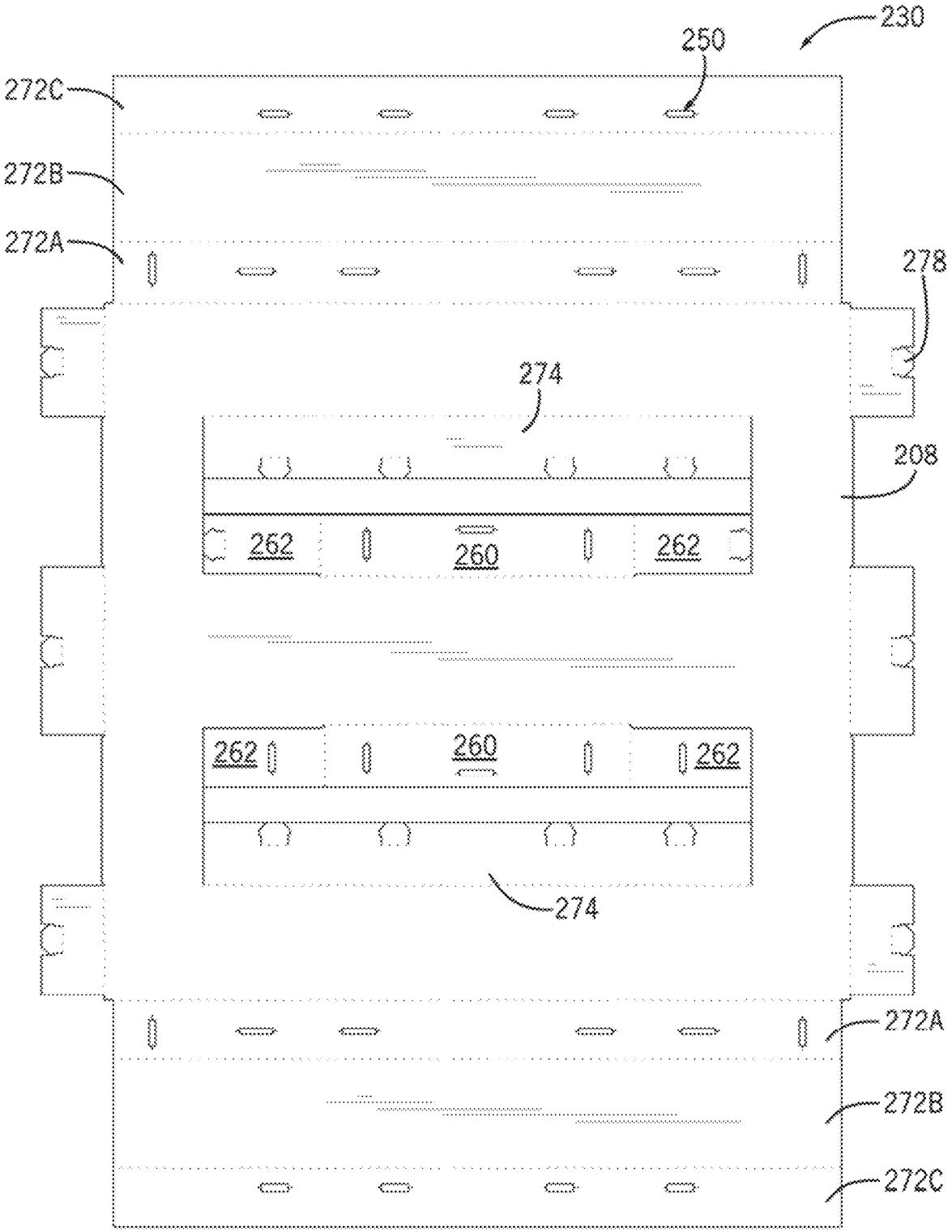
FIG. 17 is a top plan view of the bottom blank of FIG. 16 in accordance with an embodiment of the present disclosure.

With reference to FIG. 13, the second supports 246 may include two or more support walls 254, a plurality of third side supports 306, and a central pillar support 248. The central pillar support 248 may include a first pillar member 258A and a second pillar member 258B connected together. Each of the first and second pillar members 258A, 258B may include a main panel member 260 foldably connected to the base panel 210 (e.g., to the central region 226 of the base panel 210), and a pair of side panel members 262 foldably connected to the main panel member 260. The side panel members 262 may include a tab 278 or a slot 250 to correspondingly secure the first and second pillar members 258A, 258B together. As can be seen in FIGS. 15 and 17, the tab 278 and the slot 250 are each configured substantially equivalent to the tabs 178 and the slots 150, respectively, described above.

With continued reference to FIG. 13, the support walls 254 are configured substantially equivalent to the support walls 154 described above. In particular, the support walls 254 may be foldably constructed from three or more wall panels 272 and a securing panel 274 extending adjacent and secured to one of the three or more wall panels 272. For example, a first wall panel 272A may be foldably connected to the outer region 224 of the base panel 210, a second wall panel 272B may be foldably connected to the first wall panel 272A, and a third wall panel 272C may be foldably connected to the second wall panel 272B. The securing panel 274, which may be foldably connected to the central region 226 of the base panel 210, may be secured to the third wall panel 272C through, for example, corresponding tabs 278 and slots 250. As shown, the first wall panel 272A includes a plurality of slots 250 operable to receive the tabs 278 of the second side supports 300 and the tabs 278 of the corner supports 296.

Continuing to refer to FIG. 13, the third side supports 306 may be foldably connected to the outer region 224 of the base panel 210. Each of the third side supports 306 includes a tab 278 operable to secure each third side support 306 to a corner support 296 or a first side support 298 of the first member 202. In such embodiments, each corner support 296 and each first side support 298 may include a slot 250 (e.g., in the main panels 286) that corresponds in size and shape with the tabs 278 of the third side supports 306.

The first member 202 is foldably constructed by assembling the corner supports 296, the first side supports 298, the second side supports 300, and the lock mechanism 294. The corner supports 296 are assembled by folding the main panel 286 of the corner supports 296 towards the second member 204 until the main panel 286 of the corner supports 296 is substantially perpendicular to the support panel 208. The side panel 288 of the corner supports 296 is then folded inwardly until the side panel 288 is substantially perpendicular to the main panel 286 of the corner supports 296. The first side supports 298 are assembled, for example, by first folding the main panel 286 of the first side supports 298 towards the second member 204 until the main panel 286 of the first side supports 298 is substantially perpendicular to the support panel 208. The secondary panel 302 is then folded towards the first member 202 until the secondary panel 302 is parallel to the main panel 286 of the first side supports 298, and extends substantially perpendicular to the support panel 208. Each of the panel extensions 304 are then folded inwardly until each panel extension 304 is substantially perpendicular to the secondary panel 302. The side panels 288 of the first side supports 298 are then folded inwardly and, in some embodiments, secured to the panel extensions 304 by, for example, a corresponding tab 278 and slot 250. The second side supports 300 are assembled by folding the main panel 286 of the second side supports 300 towards the second member 204 until the main panel 286 of the second side supports 300 is substantially perpendicular to the support panel 208. The lock mechanism 294 is assembled by folding the lock mechanism 294 towards the second member 204.

The second member 204 is foldably constructed by assembling the support walls 254, the central pillar support 248, and the third side supports 306. The support walls 254 are assembled, for example, by first folding the first wall panel 272A towards the first member 202 until the first wall panel 272A extends substantially perpendicular to the base panel 210. The second wall panel 272B of each support wall 254 may then be folded inwardly until the first and second wall panels 272A, 272B are substantially perpendicular. The third wall panel 272C may then be folded towards the base panel 210 until the third wall panel 272C is substantially perpendicular to both the second wall panel 272B and the base panel 210. The securing panel 274 may then be folded towards the first member 202 until the securing panel 274 extends substantially perpendicular to the base panel 210 and parallel to the third wall panel 272C. The tabs 278 of the securing panel 274 may then be inserted into the slots 250 defined in the third wall panel 272C.

The central pillar support 248 is assembled, for example, by folding the main panel members 260 of each of the first and second pillar members 258A, 258B vertically upward towards the first member 202 until the main panel members 260 are substantially perpendicular to the base panel 210. The side panel members 262 of the first pillar member 258A are then folded horizontally towards the second pillar member 258B until the side panel members 262 are substantially perpendicular to the main panel member 260 of the first pillar member 258A. Similarly, the side panel members 262 of the second pillar member 258B are folded towards the first pillar member 258A until the side panel members 262 are substantially perpendicular to the main panel member 260 of the second pillar member 258B, and extend adjacent to the side panel members 262 of the first pillar member 258A. The side panel members 262 are then secured together by, for example, a corresponding tab 278 and slot 250. The third side supports 306 are assembled by folding the third side supports 306 toward the first member 202 until the third side supports 306 are substantially perpendicular to the base panel 210.

With reference to FIG. 13, the force-resisting structure 200 is constructed by connecting the first member 202 to the second member 204. For example, the first member 202 may be positioned or otherwise placed on top of the second member 204 so the first and second supports 284, 246 are in aligned position. For example, each of the corner supports 296 and the second side supports 300 may be connected to one of the support walls 254. The first side supports 298 may be connected to central pillar support 248 (e.g., connecting the panel extensions 304 of the first side supports 298 to the main panel members 260 of the central pillar support 248). Each of the third side supports 306 may be connected to one of the corner supports 296 and the first side supports 298, and the lock mechanism 294 may be connected to the main panel members 260 of the central pillar support 248. To secure the first member 202 to the second member 204, each tab 278 or slot 250 of the first supports 284 is connected to a corresponding slot 250 or tab 278 in the second supports 246, as explained above.

Third Embodiment

FIGS. 18-23 illustrate another embodiment of a force-resisting structure 400. With the exception of the description below, the force-resisting structure 400 is similar to the force-resisting structures 100, 200 and their associated description above. In certain instances, descriptions of like features will not be discussed when they would be apparent to those with skill in the art in light of the description above and in view of FIGS. 18-23. For ease of reference, like structure is represented with appropriately incremented reference numbers.

Figure 18:
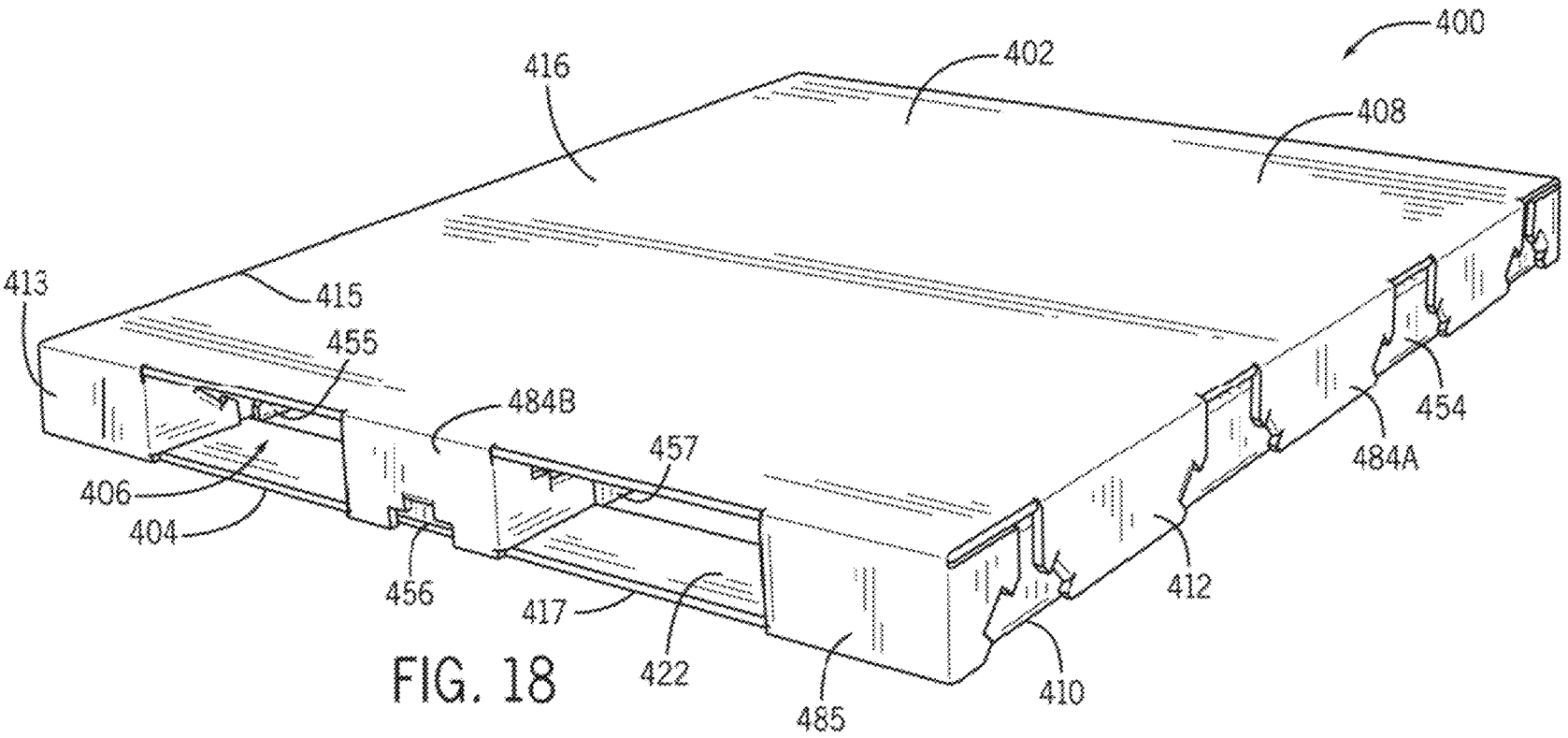
FIG. 18 is a top isometric view of a third embodiment of a force-resisting structure in accordance with an embodiment of the present disclosure.
Figure 19:
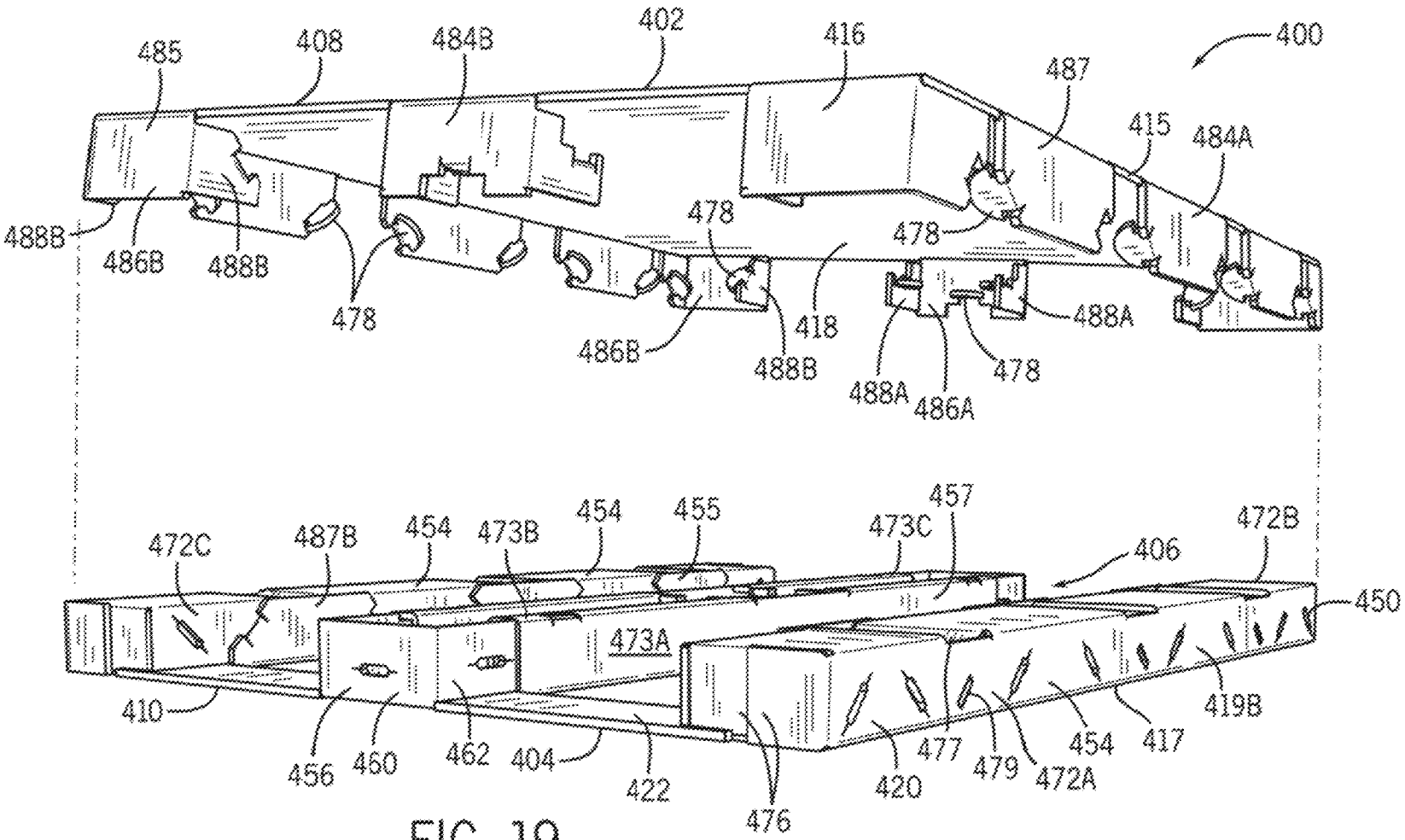
FIG. 19 is an exploded view of the force-resisting structure of FIG. 18 in accordance with an embodiment of the present disclosure.

Referring to FIGS. 18 and 19, the force-resisting structure 400 may be constructed or assembled by folding and/or interlocking portions of the force-resisting structure 400 together. Like the force-resisting structures 100, 200 discussed above the force-resisting structure 400 includes top and bottom blanks 402, 404 secured together, each of the top and bottom blanks 402, 404 being foldably constructed or assembled. In some embodiments, the top and bottom blanks 402, 404 may be coupled together, such as interlocked with each other, to define a substantially rigid structure operable to support a load received thereon. In such embodiments, the combination of the top and bottom blanks 402, 404 defines an upper deck or support panel 408 for receiving a load, and a lower deck or base panel 410 for supporting the load against a load surface (e.g., a floor or rack). With reference to FIGS. 20-24, before folding, each of the top and bottom blanks 402, 404 is a generally planar member having an interior surface 418, 422 and an exterior surface 416, 420, respectively. In a preferred embodiment, the top and bottom blanks 402, 404 are secured together by connecting the interior surface 418 of the top blank 402 to the exterior surface 420 of the bottom blank 404 (see FIGS. 18 and 19), as explained in detail below.

With reference to FIG. 18, the force-resisting structure 400 generally includes a top surface (i.e., at least a portion of the exterior surface 416 of the top blank 402) and a bottom surface (i.e., at least a portion of the exterior surface 420 of the bottom blank 404) spatially separated from the top surface by a peripheral wall 412 defined by a plurality of sidewalls 413 extending between the top and bottom surfaces. In some embodiments, the sidewalls 413 may be configured to define a plurality of fork passages or apertures 406 on at least one of the sides of the force-resisting structure 400. The fork passages 406 may be sized to receive one or more tines from a pallet jack or other lifting mechanism to lift and/or move the force-resisting structure 400 when loaded with shipping goods. To that end, while the force-resisting structure 400 shown in FIG. 18 includes fork passages 406 on two sides, in some embodiments, the force-resisting structure 400 may include fork passages 406 on each or only one side. Similarly, in instances where the force-resisting structure 400 is not used as a pallet, the fork passages 406 may be omitted and each of the sidewalls 413 may extend along the entire length of each side of the force-resisting structure 400. As explained below, sidewalls 413 extending the length of a respective side of the force-resisting structure 400 may increase the rigidity and/or strength of the force-resisting structure 400 in resisting a load received thereon.

Similar to the force-resisting structures 100, 200 described above, the force-resisting structure 400 may be formed from foldable materials, such as corrugated cardboard, paperboard, plastic, or the like. In such embodiments, the components of the force-resisting structure 400 may be formed from flat blanks of material that are foldably constructed or assembled. To aid in assembly, each of the top and bottom blanks 402, 404 may include fold lines defined thereon, such as by a line drawn on the top and bottom blanks 402, 404 or by other methods of indication, including but not limited to lines of perforation. In such embodiments, the fold lines, which are represented by dotted lines in FIGS. 20-23, may be perforated to, for example, aid in foldably constructing the top and bottom blanks 402, 404. Like the description above, the components of the force-resisting structure 400 may be formed in any suitable manner, such as by die or stamp cutting, and may be treated in various ways such that the components are moisture, water, fire, and/or bacteria resistant.

Figure 20:
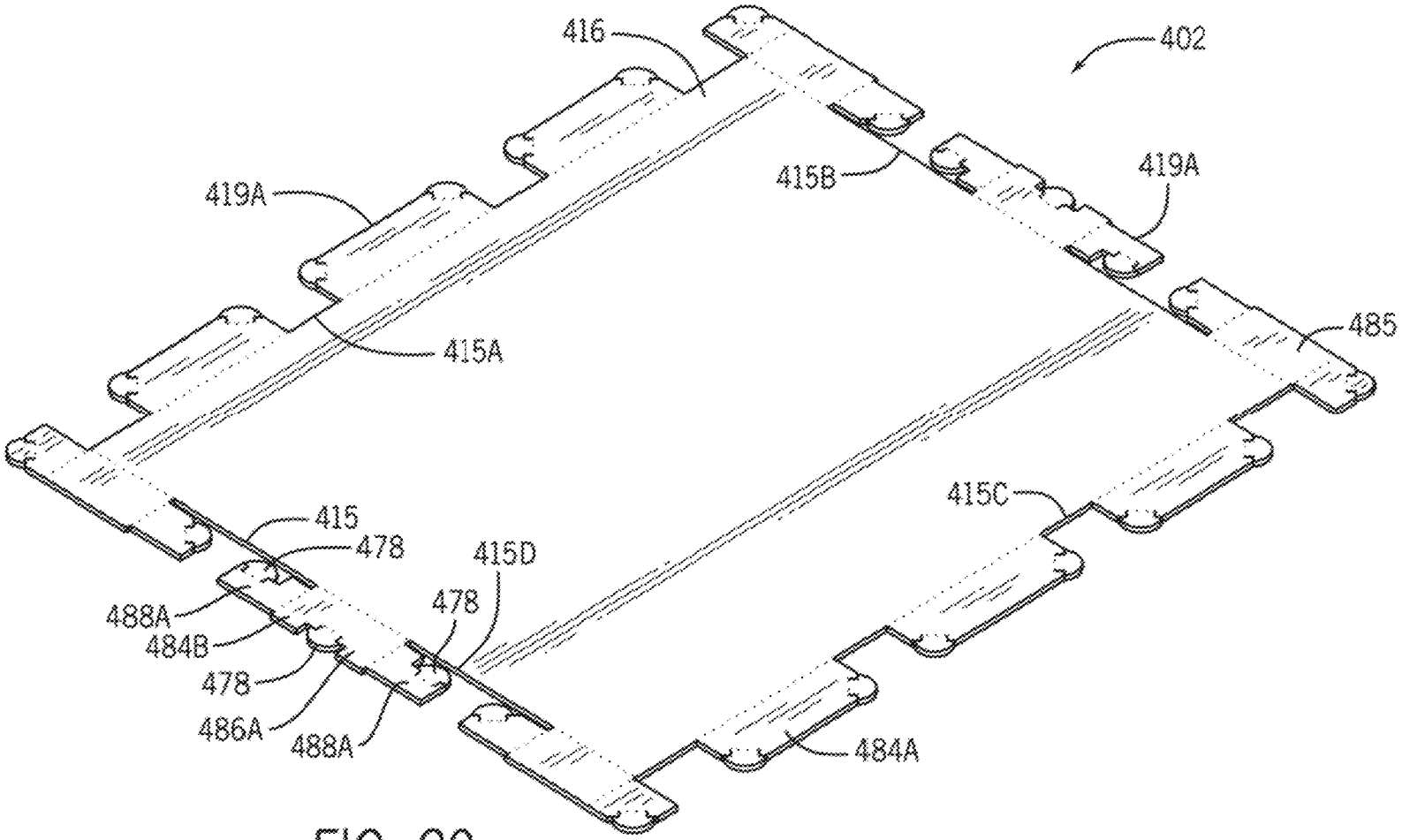
FIG. 20 is an isometric view of a third embodiment of a top blank in accordance with an embodiment of the present disclosure.
Figure 21:
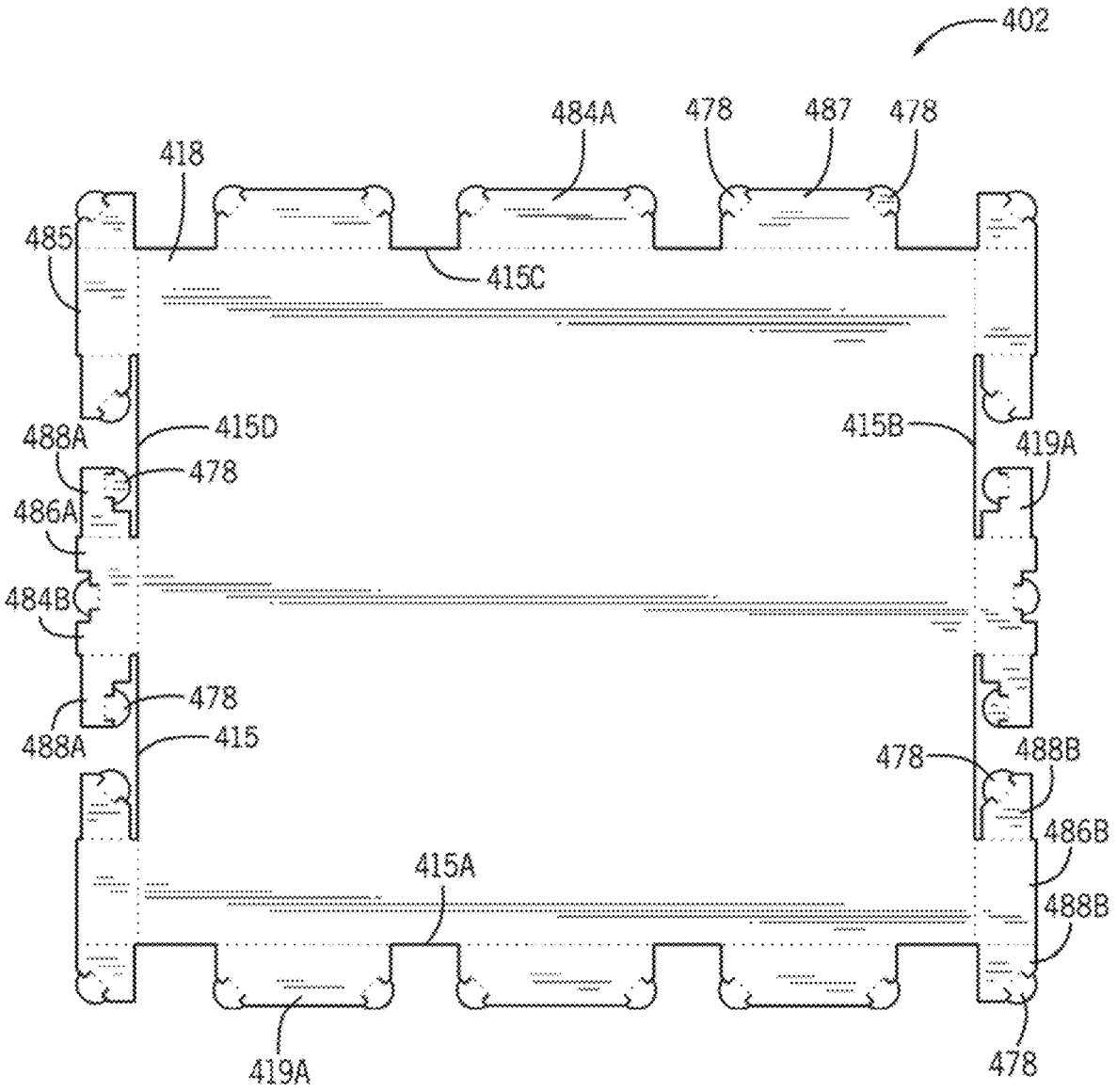
FIG. 21 is a bottom plan view of the top blank of FIG. 20 in accordance with an embodiment of the present disclosure.

FIGS. 20 and 21 illustrate one embodiment of the top blank 402 in an unfolded configuration. As shown, the top blank 402 includes a perimeter edge 415 defining first, second, third, and fourth perimeter edges 415A, 415B, 415C, 415D of the top blank 402 that together define a perimeter of the force-resisting structure 400 when in a folded configuration (see FIG. 18). A plurality of external sidewalls 419A may be associated with the first, second, third, and fourth edges 415A, 415B, 415C, 415D to surround the perimeter edge 415. Each of the external sidewalls 419A pivot relative to the interior surface 418, such as approximately 90 degrees or at a right angle relative to the interior surface 418, to form support structures, such as a portion of a pillar or column, for the force-resisting structure 400. In such embodiments, at least a portion of each external sidewall 419A may pivot adjacent (e.g., along) the perimeter edge 415. Depending on the particular application, portions of the external sidewalls 419A may be attached to the perimeter edge 415 while other portions may be detached, thus allowing rotation of a portion of the external sidewalls 419A along other directions to, for example, increase the strength and/or rigidity of the force-resisting structure 400, as explained more fully below.

Referring to FIGS. 20 and 21, the external sidewalls 419A of the top blank 402 may be folded to define one or more corner supports 485 and one or more edge supports, such as one or more first edge supports 484A and one or more second edge supports 484B, spaced apart along the perimeter edge 415 of the top blank 402. For example, the first and third perimeter edges 415A, 415C of the top blank 402 may each include three first edge supports 484A spaced apart along the respective edge. In such embodiments, the second and fourth perimeter edges 415B, 415D of the top blank 402 may each include a single second edge support 484B positioned in substantially the middle of the respective edge. As shown, two corner supports 485 may flank the single second edge support 484B along each of the second and fourth perimeter edges 415B, 415D. In such embodiments, each edge of the top blank 402 may include at least three support structures. As discussed below, each of the corner supports 485 and each of the edge supports interface with support structures defined on the bottom blank 404 to secure the top blank 402 to the bottom blank 404. For ease of reference, each corner support 485 may be substantially similar to the other, and thus, description of one corner support 485 should be understood to apply to the other corner supports 485. Similarly, each first edge support 484A may be substantially similar to the other, and description of one first edge support 484A should be understood to apply to the other first edge supports 484A. The same limitation may apply to each second edge support 484B.

With continued reference to FIGS. 20 and 21, each first edge support 484A may include a main panel member or support wall 487 rotatably coupled to the interior surface 418 of the top blank 402 with a plurality of tabs 478 (e.g., two tabs) rotatably coupled to the support wall 487. As explained below, each of the tabs 478 may be operable to secure the first edge supports 484A to an adjacent structure of the bottom blank 404. As shown, the support wall 487 is connected to the top blank 402 along the perimeter edge 415 such that the support wall 487 is rotatably relative to the interior surface 418 of the top blank 402. In some embodiments, the support wall 487 may be formed integrally with the support panel 408, and each of the tabs 478 may be formed integrally with the support wall 487. As shown in FIG. 19, in a folded configuration, the support wall 487 of each first edge support 484A is positioned on the perimeter edge 415 at approximately a 90 degree angle relative to the interior surface 418 of the top blank 402. In such embodiments, the tabs 478 extend at approximately 90 degrees from a portion of the support wall 487, such as from the side ends of the support wall 487, towards the interior of the top blank 402.

Referring back to FIGS. 20 and 21, each second edge support 484B may include a support wall 486A similar to the first edge supports 484A. Unlike the first edge supports 484A, however, each second edge support 484B may include a plurality of side panel members or flaps 488A (e.g. two flaps) rotatably connected to the support wall 486A. In such embodiments, each flap 488A may include one or more tabs 478 rotatably coupled thereto, the tabs 478 operable to connect the second edge supports 484B to an adjacent structure of the bottom blank 404, as explained in detail below. As shown, the flaps 488A extend from either side of the support wall 486A, but are disconnected (e.g., through a cut line or the like) from the interior surface 418 of the top blank 402. In this manner, the flaps 488A can pivot along two axes relative to the interior surface 418. More particularly, the flaps 488A pivot along a first axis relative to the interior surface 418 when the associated support wall 486A pivots downwards from the interior surface 418 of the top blank 402, and also pivot along a second axis as the flaps 488A pivot towards the support wall 486A, as detailed more fully below. In some embodiments, the flaps 488A pivot approximately 90 degrees or at a right angle relative to the support wall 486A to form the support structures.

As shown in FIG. 19, in a folded configuration, each second edge support 484B defines a U-shaped support structure with the support wall 486A being positioned on the perimeter edge 415 of the interior surface 418 of the top blank 402, and the rotatable flaps 488A extending at approximately 90 degrees from the ends of the support wall 486A and into an interior of the top blank 402. In such embodiments, the tabs 478 may extend at approximately 90 degrees from a portion of the flaps 488A, such as from the ends of the flaps 488A, towards each other to engage corresponding structure of the bottom blank 404 received therebetween.

Referring again to FIGS. 20 and 21, each corner support 485 may be configured similarly to the second edge supports 484B. In particular, each corner support 485 may include a support wall 486B rotatably connected to the interior surface 418 of the top blank 402 similar to the first and second edge supports 484A, 484B. Like the second edge supports 484B, each corner support 485 includes a plurality of flaps 488B (e.g., two flaps) rotatably connected to the sides of the support wall 486B. Also, each flap 488B may include one or more tabs 478 rotatably coupled thereto. The support wall 486B may be connected to the perimeter edge 415 adjacent a corner of the interior surface 418 and rotatable relative thereto along the connected edge. The flaps 488B are connected along a side edge to the support wall 486B but are separated from the perimeter edge 415, thus allowing the flaps 488B to extend towards the interior of the top blank 402 when in a folded configuration (see FIG. 19). In some embodiments, the flaps 488B may be asymmetrically configured relative to the support wall 486B. For example, in an unfolded configuration, the tabs 478 of opposing flaps 488B may extend in opposing directions. In particular, the tab 478 of one flap 488B may extend away from the interior of the top blank 402 whereas the tab 478 of an opposing flap 488B may extend towards the interior of the top blank 402 when the top blank 402 is in an unfolded configuration.

As shown in FIG. 19, in a folded configuration, each corner support 485 defines a U-shaped support structure similar to the second edge supports 484B. Namely, the support wall 486B may be positioned on the perimeter edge 415 at approximately a 90 degree angle relative to the interior surface 418 of the top blank 402. In such embodiments, the flaps 488B may extend into the interior of the top blank 402 at approximately 90 degrees from the ends of the support wall 486B. Like the description above, the tabs 478 may extend at approximately 90 degrees from a portion of the flaps 488B, such as from the ends of the flaps 488B, towards each other to engage corresponding structure of the bottom blank 404 received therebetween, as explained more fully below.

In the embodiments described herein, the size of the corner supports 485 and the first and second edge supports 484A, 484B, among others, may determine the size of the fork passages 406, which in turn may determine the size and/or strength of the force-resisting structure 400. For example, the taller the support walls 486A, 486B, 487, the taller the fork passages 406. Similarly, the narrower the support walls 486A, 486B, 487, the wider the fork passages 406. However, reducing the length and/or increasing the height of the support walls 486A, 486B, 487 may reduce the structural rigidity and support of the force-resisting structure 400. Accordingly, the size of the support walls 486A, 486B, 487 may be selected by balancing a desired fork aperture size with the structural strength requirements for the force-resisting structure 400.

Figure 22:
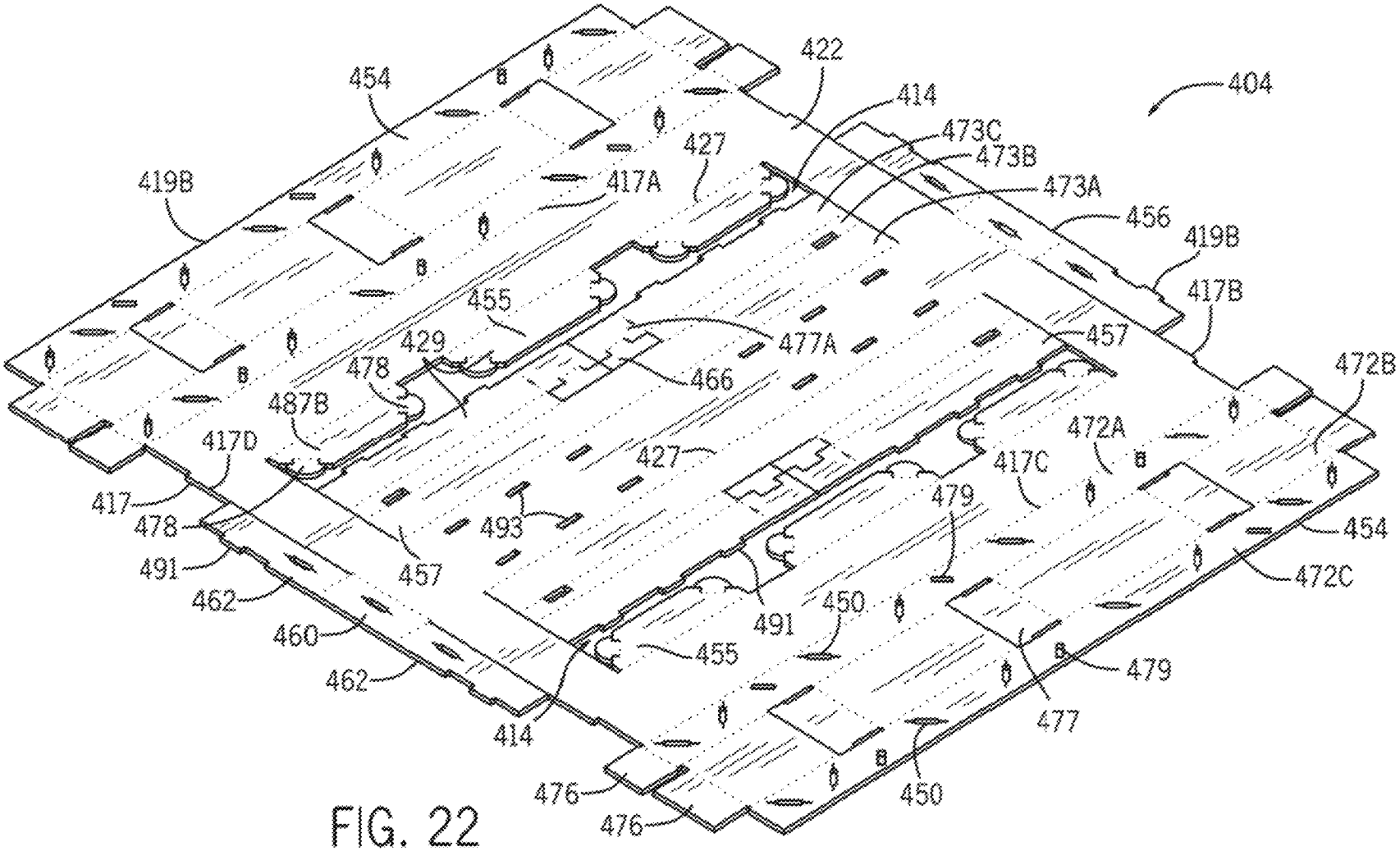
FIG. 22 is an isometric view of a third embodiment of a bottom blank in accordance with an embodiment of the present disclosure.
Figure 23:
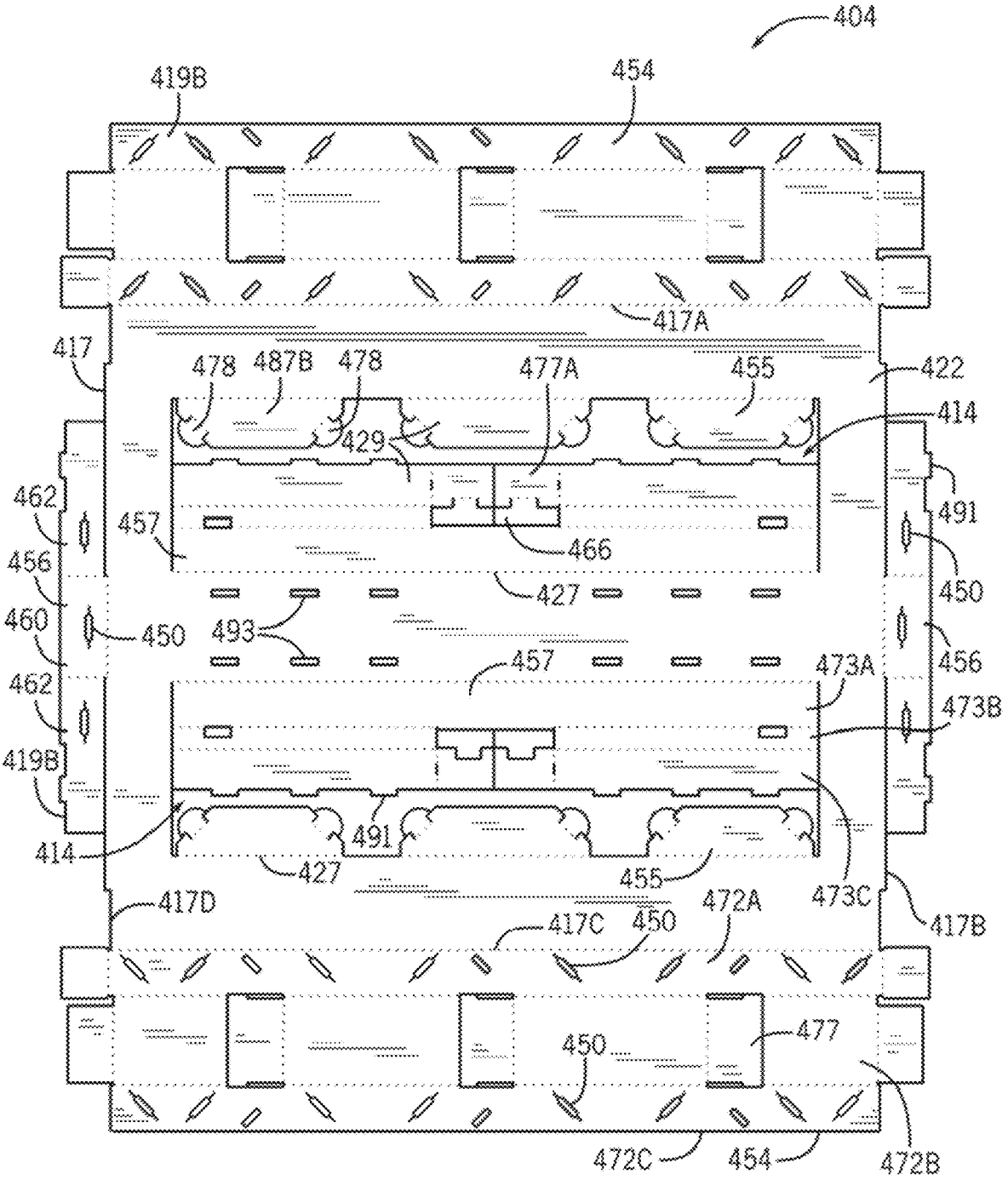
FIG. 23 is a top plan view of the bottom blank of FIG. 22 in accordance with an embodiment of the present disclosure.
Figure 23A:
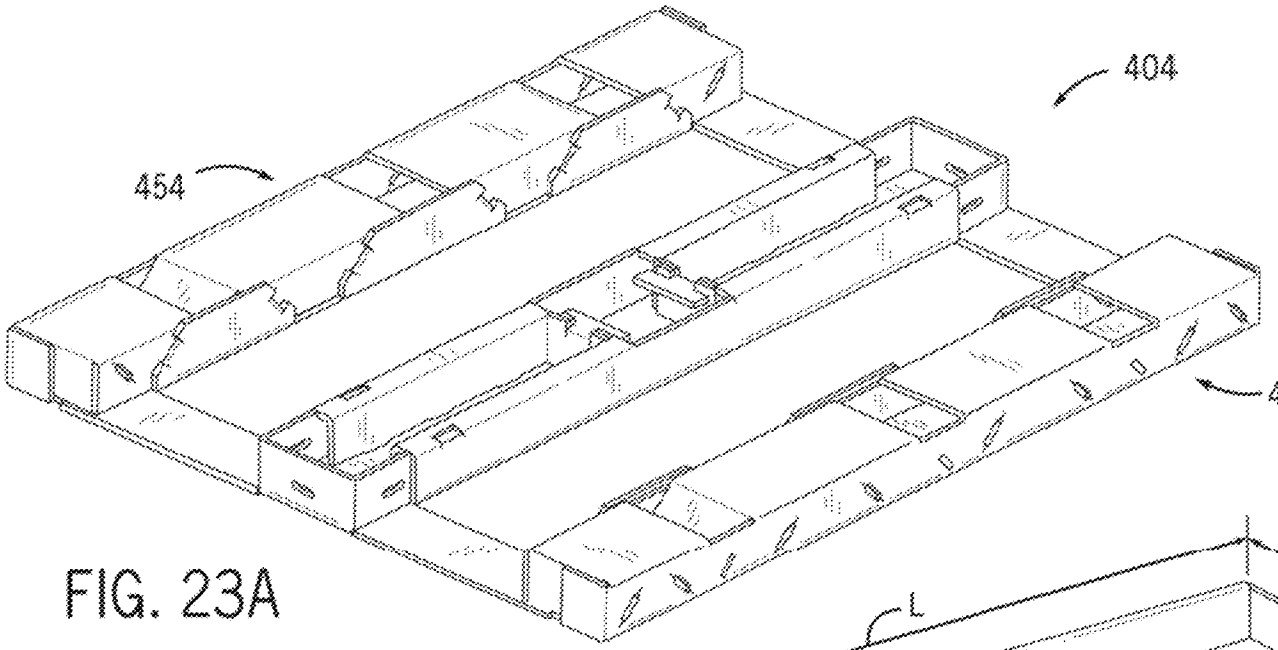
FIG. 23A is a top perspective view of the bottom blank of FIG. 22 in a folded configuration in accordance with an embodiment of the present disclosure.

The bottom blank 404 will now be discussed in more detail. With the exception of the description below, the bottom blank 404 may be configured similarly to the top blank 402 discussed above. As such, descriptions of like features will not be discussed when they would be apparent to those with skill in the art in light of the description above and in view of the figures. Turning now to the figures, FIGS. 22 and 23 illustrate one embodiment of the bottom blank 404 in an unfolded configuration. As shown, the bottom blank 404 includes a perimeter edge 417 defining first, second, third, and fourth perimeter edges 417A, 417B, 417C, 417D of the bottom blank 404 that together define a perimeter of the force-resisting structure 400 when in a folded configuration (see FIG. 18). A plurality of external sidewalls 419B surround the perimeter edge 417 and are foldable relative to the interior surface 422 of the bottom blank 404 to a position approximately normal to the interior surface 422 (see FIG. 19). As explained below, each of the external sidewalls 419B, which may be referred to as edge portions of the bottom blank 404, forms portions of support structures, such as portions of pillars or columns, that provide support between the support panel 408 and the base panel 410 of the force-resisting structure 400.

In one embodiment, the external sidewalls 419B of the bottom blank 404 may be folded to define one or more edge supports, such as one or more first external edge supports 454 and one or more second external edge supports 456, spaced apart along the perimeter edge 417 of the bottom blank. As shown in FIGS. 22 and 23, the first external edge supports 454, which may be referred to as support columns, may be formed on two opposing edges of the interior surface 422, such as on the first and third perimeter edges 417A, 417C. The second external edge supports 456 may be formed on the remaining two opposing edges of the interior surface 422, such as on the second and fourth perimeter edges 417B, 417D. In some embodiments, the first external edge supports 454 may be substantially similar to one another and may differ only in position along the perimeter edge 417. Additionally or alternatively, the second external edge supports 456 may be substantially similar to one another and may differ only in position along the perimeter edge 417. As shown, each first external edge support 454 extends along the length of the connected edge such that the first external edge supports 454 extend entirely along its respective side of the force-resisting structure 400 (see FIG. 19). In such embodiments, a single second external edge support 456 may be positioned on each of the second and fourth perimeter edges 417B, 417D, such as substantially in the middle of the respective edge. As discussed below, each of the edge supports of the bottom blank 404 interface with the edge supports of the top blank 402 to at least partially secure the bottom blank 404 to the top blank 402.

As shown in FIGS. 22 and 23, each first external edge support 454 may be foldably constructed from 2 or more wall panels 472. For instance, a first wall panel 472A may be rotatably connected to the interior surface 422 of the bottom blank 404, and a second wall panel 472B may be rotatably connected to the first wall panel 472A opposite the line of connection between the first wall panel 472A and the interior surface 422 of the bottom blank 404. In such embodiments, a third wall panel 472C may be rotatably connected to the second wall panel 472B opposite the first wall panel 472A such that the first, second, and third wall panels 472A, 472B, 472C of each first external edge support 454 are arranged side-by-side laterally away from the interior surface 422 of the bottom blank 404. As shown, each of the first and third wall panels 472A, 472C includes a plurality of slots 450 defined thereon and operable to receive corresponding structure of the top and bottom blanks 402, 404 therein to secure the bottom edge supports in position and to secure the top blank 402 to the bottom blank 404, as explained below.

Referring to FIG. 19, in a folded configuration, each first external edge support 454 defines a U-shaped support structure. Once folded, the first wall panel 472A may be positioned on the perimeter edge 417 at approximately a 90 degree angle relative to the interior surface 422 of the bottom blank 404, such as towards the top blank 402. In such embodiments, the second wall panel 472B may extend into the interior of the bottom blank 404 at approximately 90 degrees from the end of the first wall panel 472A such that the second wall panel 472B extend substantially parallel to the interior surface 422 of the bottom blank. The third wall panel 472C may extend at approximately 90 degrees from the second wall panel 472B towards the interior surface 422 of the bottom blank 404. In this manner, each first external edge support 454 defines a box-shaped support structure with the interior surface 422 of the bottom blank 404 when in the folded configuration. In this manner, the first external edge supports 454 are defined by triple-folding the first external edge supports 454 relative to the interior surface 422 and towards the interior of the bottom blank 404. As explained below, the first external edge supports 454 may be secured in position with additional structure within the interior of the bottom blank 404.

In some embodiments, the bottom blank 404 includes a length and width. As illustrated in at least FIG. 19, once folded, the first external edge supports 454 may extend the width or length of the bottom blank 404. For example, at least two external sidewalls 419B (such as opposing external sidewalls 419B) may be folded along at least three fold lines extending the width or length of the bottom blank 404 in the manner described above. Once folded, the first external edge supports 454 may extend the entire width or length of the force-resisting structure 400, such as the width or length of the bottom blank 404. In such embodiments, each of the first external edge supports 454 may include an exterior surface defining a portion of the sidewalls 413, such as the exterior sidewalls of the bottom blank 404. In this manner, the exterior surface of the first external edge supports 454 may be defined by a bottom surface of the bottom blank 404 before the external sidewalls 419B are folded. In fact, in some embodiments, all of the surfaces forming the first external edge supports 454 initially form a bottom surface of the bottom blank 404. Once folded, the bottom surface of the bottom blank 404 may define the exterior sidewalls, the interior sidewalls, and the interior top wall of the first external edges supports 454.

With reference to FIGS. 22 and 23, the first external edge supports 454 may include additional features and/or structure depending on a desired aesthetic and/or functional characteristic of the supports. For example, the first external edge supports 454 may include a plurality of cover members 476 extending from either side of the first wall panel 472A and/or the second wall panel 472B. For instance, two cover members 476 may extend from opposing sides of the first wall panel 472A, and two cover members 476 may extend from opposing sides of the second wall panel 472B. Once the first external edge supports 454 are folded into position, the cover members 476 may cover an open end of the created box-shaped support structure (see FIG. 19). For example without limitation, the cover members 476 extending from the second wall panel 472B may be rotated downwards towards the interior surface 422 of the bottom blank 404 to at least partially cover the open end of the first external edge supports 454. Additionally or alternatively, the cover members 476 extending from the first wall panel 472A be rotated inward towards the interior of the bottom blank 404 to at least partially cover the open end of the first external edge supports 454 and/or the cover members 476 associated with the second wall panel 472B. In this manner, the cover members 476 may be operable to provide a clean look to the corners of the bottom blank 404 as well as limit debris or material from entering the interior of the box-shaped first external edge supports 454.

With continued reference to FIGS. 22 and 23, a plurality of secondary flaps 477 may be rotatably connected within the interior of the second wall panel 472B. Once the first external edge supports 454 are folded into position, the secondary flaps 477 may be rotated into the interior of the box-shaped first external edge supports 454 to provide additional torsional rigidity to the first external edge supports 454 (see FIG. 19). In some embodiments, the secondary flaps 477 may be secured into place by receipt of at least a portion of the secondary flaps 477 within apertures 479 defined within the first and third wall panels 472A, 472C. In such embodiments, a width of the secondary flaps 477 may be greater than the assembled distance between the first and third wall panels 472A, 472C to limit removal of the secondary flaps 477 from the apertures 479.

As shown in FIGS. 22 and 23, each second external edge support 456 of the bottom blank 404 may include a support wall 460 rotatably connected to the interior surface 422 of the bottom blank 404. In some embodiments, a plurality of side panels 462 (e.g., two side panels) may be rotatably connected to the support wall 460. The side panels 462 are connected along a side edge to the support wall 460 but are separated from the perimeter edge 417 of the bottom blank 404, thus allowing the side panels 462 to extend towards the interior of the bottom blank 404 when in a folded configuration (see FIG. 19). In a folded configuration, each second external edge support 456 defines a U-shaped support structure with the support wall 460 positioned on the perimeter edge 417 at approximately a 90 degree angle relative to the interior surface 422 of the bottom blank 404, and the side panels 462 extending into the interior of the bottom blank 404 at approximately 90 degrees from the ends of the support wall 460 (see FIG. 19). As shown, each of the support wall 460 and the side panels 462 of the second external edge supports 456 may include at least one slot 450 defined therein for the same reasons discussed above with respect to the first external edge supports 454.

Turning to FIGS. 22 and 23, the bottom blank 404 in some embodiments may include one or more interior apertures 414 defining interior edges 427 about which internal sidewalls 429 are formed and pivot relative thereto. Similar to the external sidewalls 419B discussed above, the internal sidewalls 429 are folded relative to the interior surface 422 of the bottom blank 404 to define interior support structures, such as portions of pillars or columns, that provide support between the support panel 408 and the base panel 410 of the force-resisting structure 400. In some embodiments, the internal sidewalls 429 engage with and connect to portions of the external sidewalls 419B, such as the first and second external edge supports 454, 456.

In some embodiments, the internal sidewalls 429 may be folded to define one or more internal edge supports, such as one or more first internal edge supports 455 and one or more second internal edge supports 457, spaced along the interior edges 427 of the bottom blank. In the embodiment of FIGS. 22 and 23, each first internal edge support 455 is configured similarly to the first edge supports 484A of the top blank 402. Namely, each first internal edge support 455 includes a support wall 487A rotatably connected to the interior edge 427 of the bottom blank 404 with a plurality of tabs 478 (e.g., two tabs) rotatably coupled to the support wall 487A. When folded into position, each support wall 487A extends towards the top blank 402 at approximately a 90 degree angle relative to the interior surface 422 of the bottom blank 404 (see FIG. 19). In some embodiments, the interior face of the support wall 487A may be positioned in abutting facing relationship with the third wall panel 472C of the first external edge supports 454 (e.g., with the exterior face of the third wall panel 472C). As shown, the tabs 478 of the first internal edge supports 455 may be positioned within corresponding slots 450 defined in the third wall panel 472C to secure the first internal edge supports 455 and the first external edge supports 454 together. Though three first internal edge supports 455 are shown connected to each first external edge support 454, it is contemplated that any number of first internal edge supports 455 (e.g., as little as one or as much as six) may connect to each first external edge support 454.

Referring back to FIGS. 22 and 23, each second internal edge support 457 may be configured similarly to the first external edge supports 454. In particular, each second internal edge support 457 may be foldably constructed from 2 or more wall panels 473. For instance, a first wall panel 473A may be rotatably connected to an interior edge 427 of the bottom blank 404, and a second wall panel 473B may be rotatable connected to the first wall panel 472A opposite the line of connection between the first wall panel 473A and the interior edge 427 of the bottom blank 404. Also, a third wall panel 473C may be rotatably connected to the second wall panel 473B opposite the first wall panel 473A such that the first, second, and third wall panels 473A, 473B, 473C of each second internal edge support 457 are arranged side-by-side laterally away from the interior edge 427 and within the associated interior aperture 414. Unlike the first external edge supports 454, however, the second internal edge supports 457 may include a plurality of secondary flaps 477A rotatably connected to the third wall panel 473C. In such embodiments, a flange 466 may be rotatably connected to at least some (e.g., ½) of the secondary flaps 477A for the purposes explained below. As shown, each of the secondary flaps 477A is substantially U-shaped. In such embodiments, each of the flanges 466 is substantially T-shaped to lock the U-shaped secondary flaps 477A together, as explained below. Like the first external edge supports 454, each of the second internal edge supports 457 extends along the length of its connected edge such that the second internal edge supports 457 extend along an entire length of the interior apertures 414.

Turning to FIG. 19, in a folded configuration, each second internal edge support 457 defines a U-shaped support structure. Once folded, the first wall panel 473A may be positioned on the interior edge 427 at approximately a 90 degree angle relative to the interior surface 422 of the bottom blank 404, such as towards the top blank 402. The second wall panel 473B may extend at approximately 90 degrees from the end of the first wall panel 473A such that the second wall panel 473B extends substantially parallel to the interior surface 422 of the bottom blank 404. The third wall panel 473C may extend at approximately 90 degrees from the second wall panel 473B towards the interior surface 422 of the bottom blank 404. During assembly of the bottom blank 404, at least portions of the side panels 462 of the second external edge supports 456 may be positioned within the space defined between the first, second, and third wall panels 473A, 473B, 473C of the second internal edge support 457. In such embodiments, the second wall panels 473B may include a length approximately equal to the thickness of the bottom blank 404 such that the side panels 462 of the second external edge supports 456 are sandwiched at least between the first and third wall panels 473A, 473C of the second internal edge support 457 when in a folded configuration. For added structural rigidity, the secondary flaps 477A of adjacent second internal edge supports 457 may be secured together via the flanges 466. For example, once two adjacent second internal edge supports 457 are folded into position, the secondary flaps 477A of the adjacent second internal edge supports 457 may be rotated towards one another until the grooves within the U-shaped secondary flaps 477A are substantially aligned. Once aligned, at least one flange 466 may be rotated to within the grooves, thus locking the secondary flaps 477A and the adjacent second internal edge supports 457 together.

With reference back to FIGS. 22 and 23, the second internal edge supports 457 may include additional features and/or structure depending on a desired functional characteristic of the supports. For instance, a plurality of tabs 491 may be defined on an end of the third wall panel 473C of each second internal edge support 457. In such embodiments, corresponding apertures 493 may be defined within the interior surface 422 of the bottom blank 404 to receive the plurality of tabs 491 once the second internal edge supports 457 are folded into position. Similarly, a tab 491 may be defined on the side panels 462 of the second external edge supports 456 for receipt within a corresponding aperture 493 defined within the second wall panel 473B of the second internal edge support 457 to further lock the second external edge supports 456 and the second internal edge supports 457 together.

Turning now to FIGS. 18 and 19, to assemble the force-resisting structure 400, each of the top and bottom blanks 402, 404 are foldably constructed as outlined above. The top and bottom blanks 402, 404 are then aligned and secured together via the corresponding structures of the top and bottom blanks 402, 404. For instance, to connect the top and bottom blanks 402, 404 together, the respective tabs 478 of each of the first edge supports 484A and the corner supports 485 of the top blank 402 are received within the slots 450 defined within the first external edge supports 454 of the bottom blank 404. Similarly, the tabs 478 of the second edge supports 484B of the top blank 402 are received within the slots 450 defined within the second external edge supports 456 of the bottom blank 404. As illustrated in FIG. 18, once assembled, the corner supports 485 of the top blank 402 may substantially surround the ends of the first external edge supports 454 of the bottom blank 404. Of particular significance, when assembled, the interior surface 418 of the top blank 402 engages only the exterior surface 420 of the bottom blank 404 to secure the top and bottom blanks 402, 404 together, which may be helpful in increasing manufacturing efficiency and/or reducing assembly and handling costs. For example without limitation, in this manner, specialized treatment or coatings, such as layers of adhesive, protective sealants, or the like, may be provided on only one side of the top and bottom blanks 402, 404.

Support Tray

Figure 28:
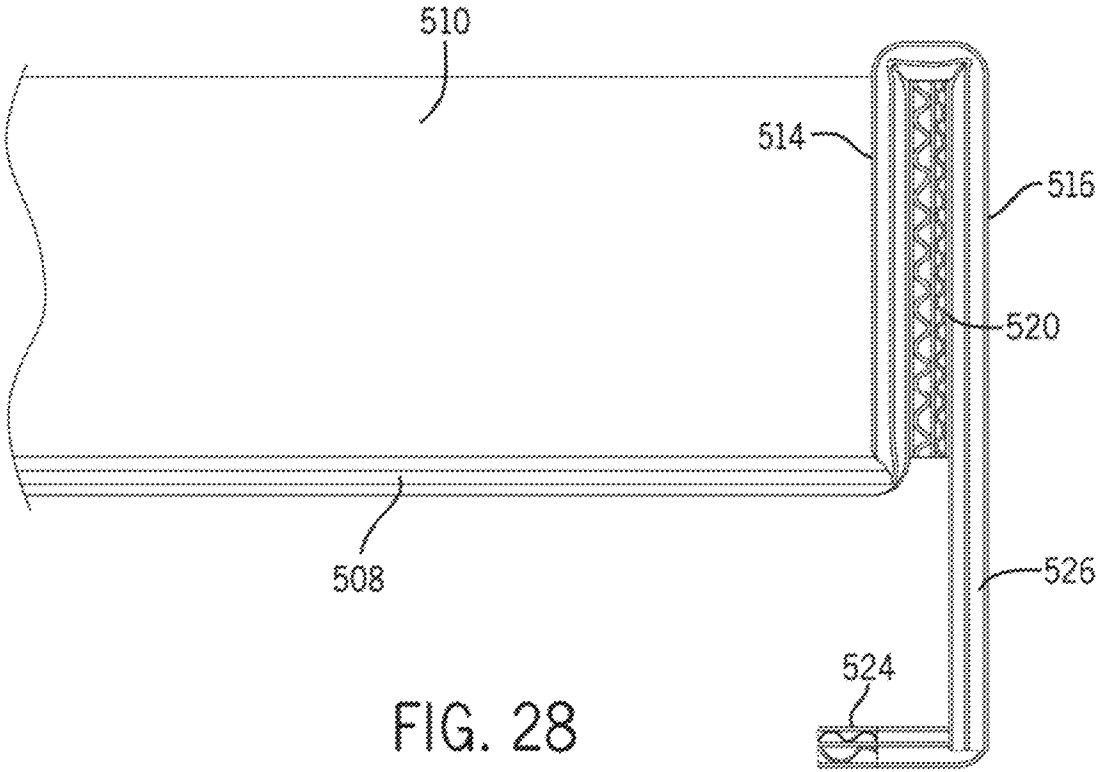
FIG. 28 is a cross-sectional view of the support tray of FIG. 25 taken along line 28-28 of FIG. 25 in accordance with an embodiment of the present disclosure.
Figure 29:
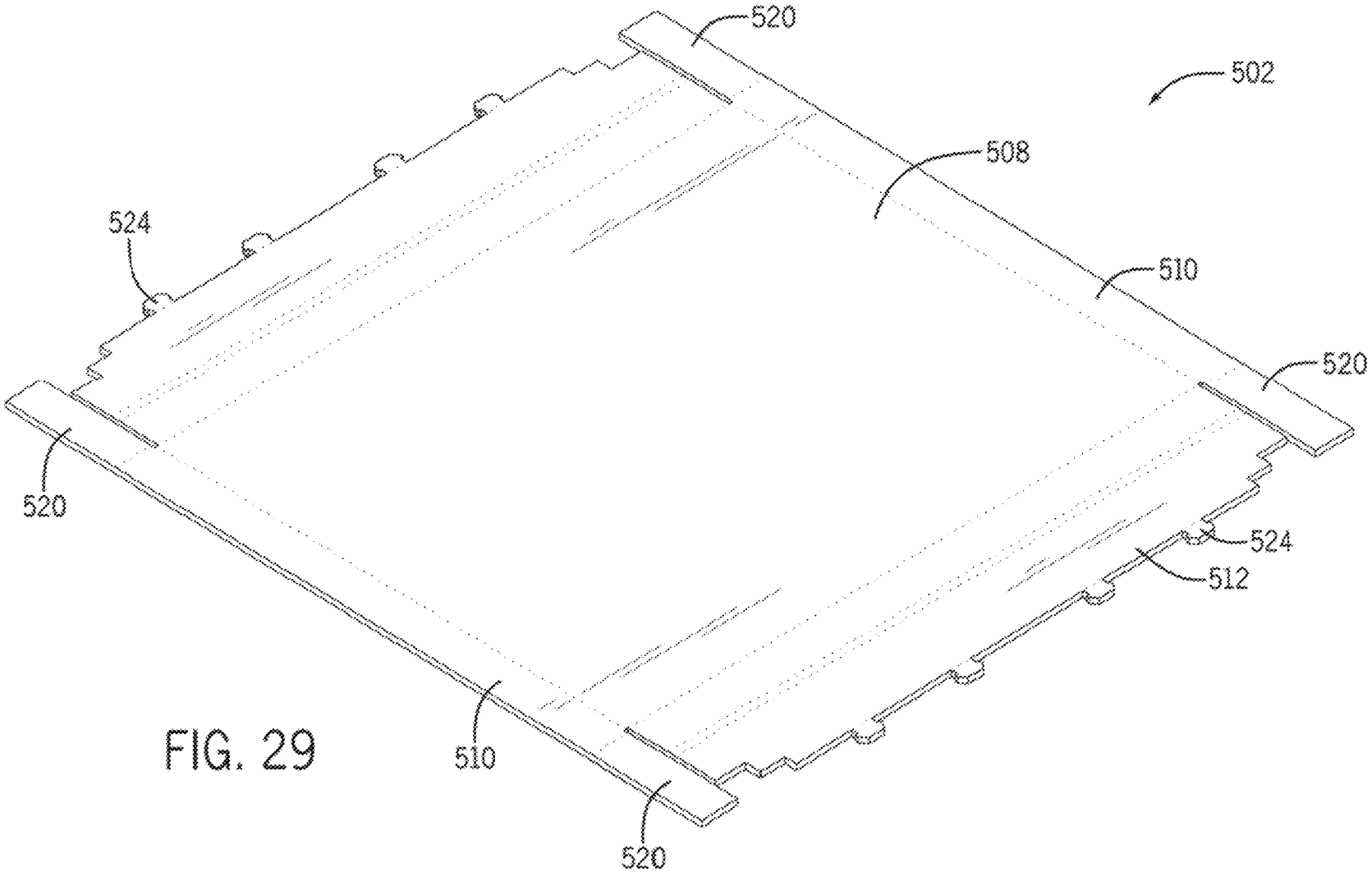
FIG. 29 is an isometric view of a tray blank in accordance with an embodiment of the present disclosure.
Figure 30:
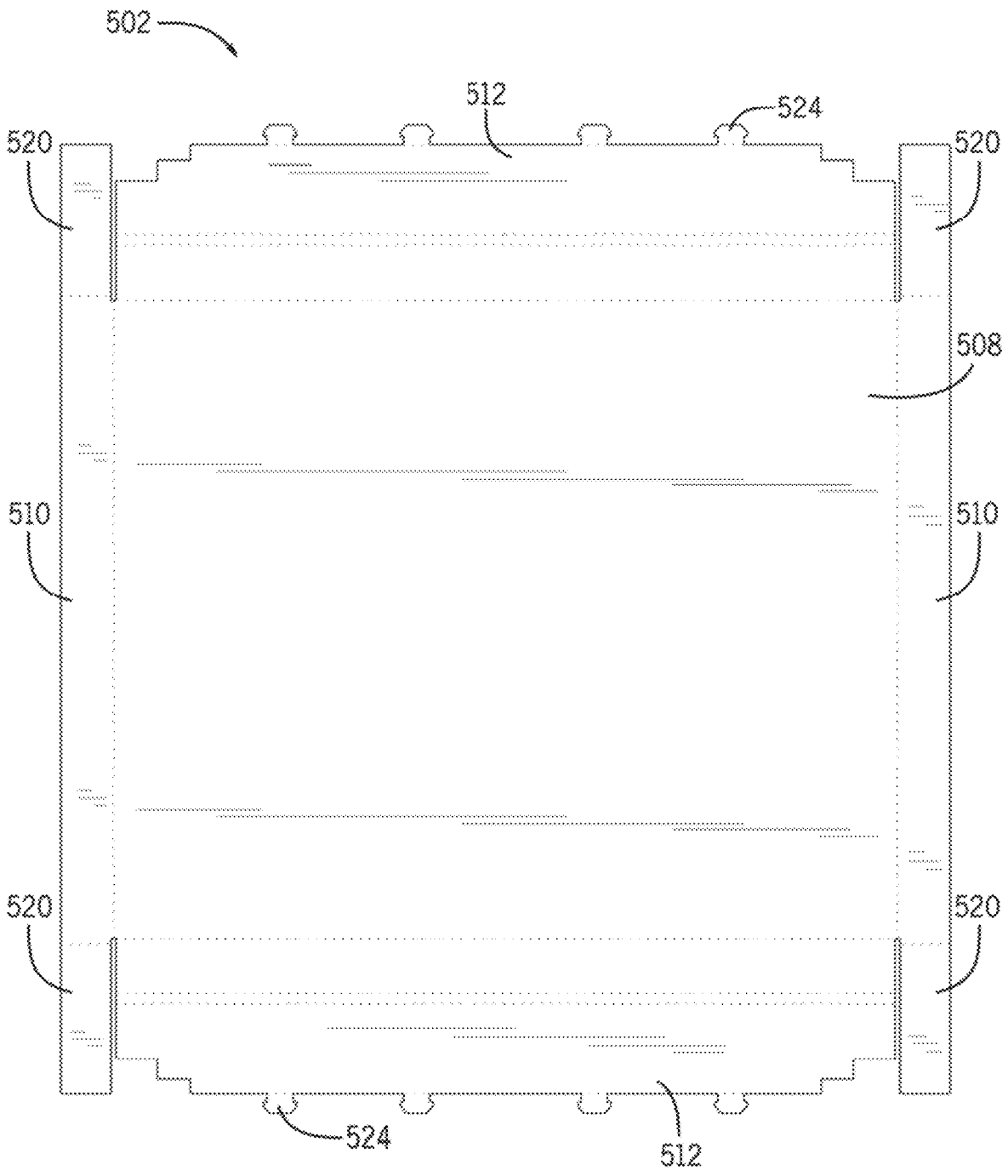
FIG. 30 is a top plan view of the tray blank of FIG. 29 in accordance with an embodiment of the present disclosure.
Figure 31:
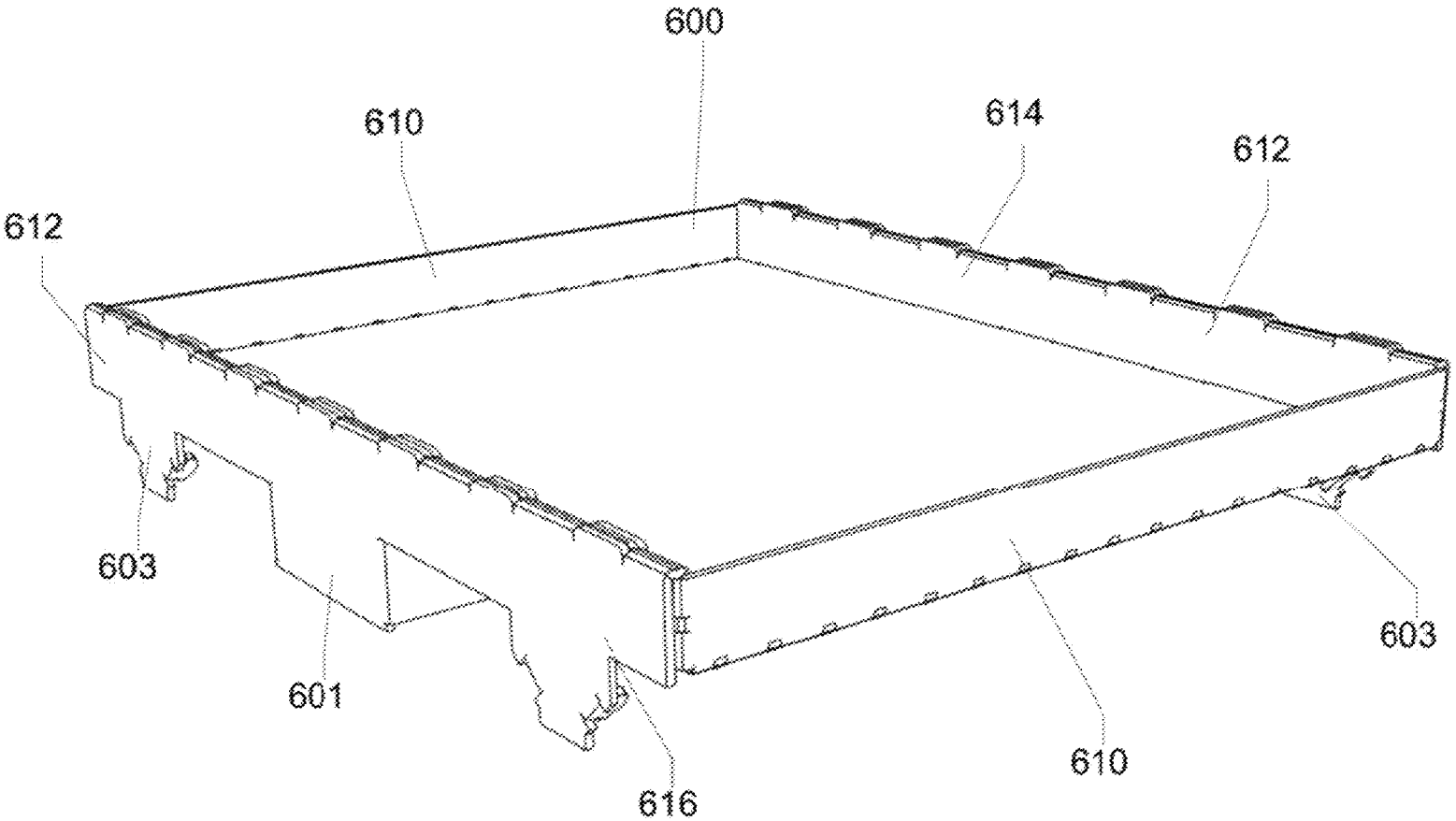
FIG. 31 is a top perspective view of an additional support tray in accordance with an embodiment of the present disclosure.
Figure 32:
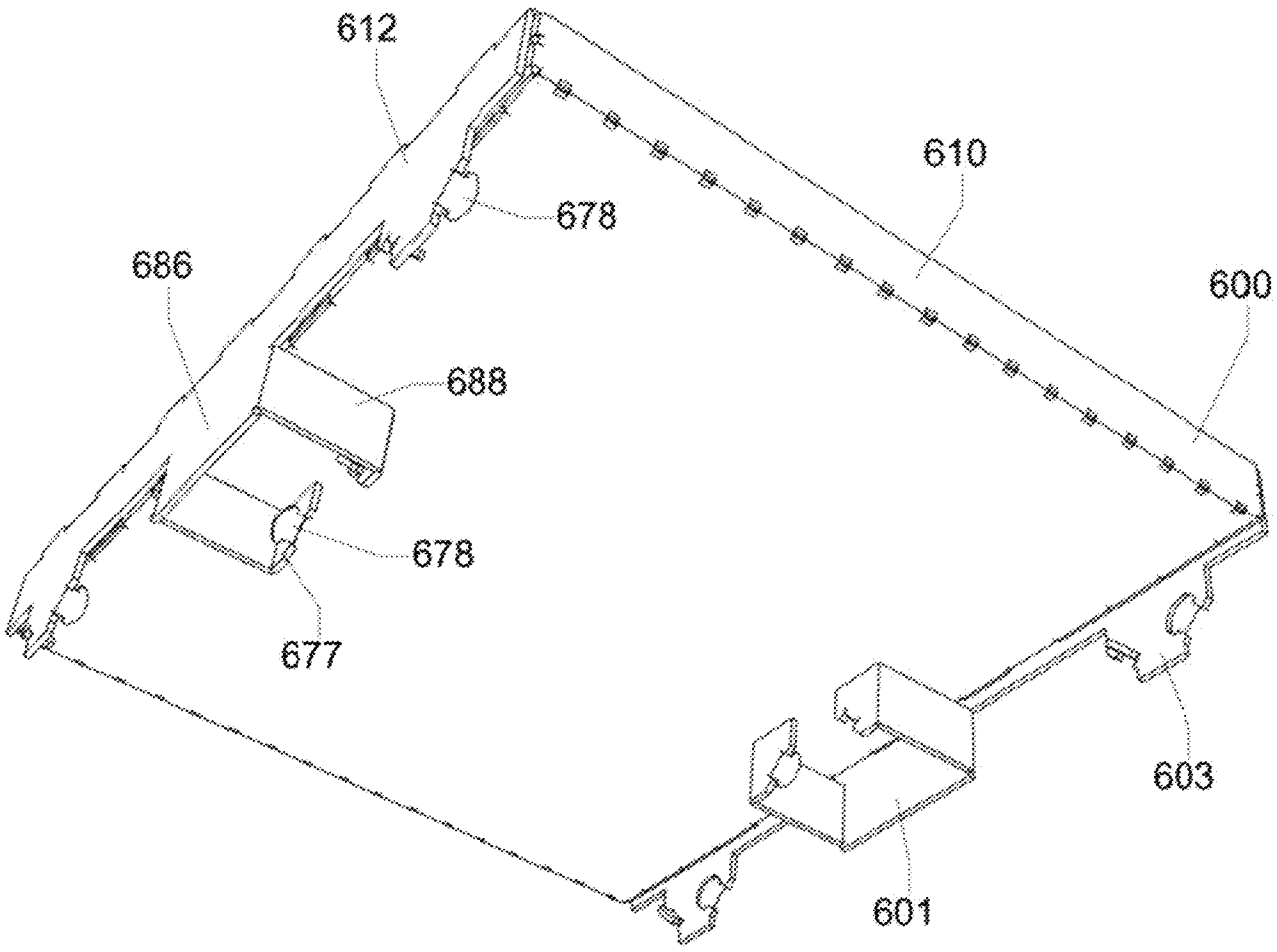
FIG. 32 is a bottom perspective view of the support tray of FIG. 31 in accordance with an embodiment of the present disclosure.

As discussed above, the force resisting structure 100, 200, 400 may be used with one or more accessories that secure to the structure 100, 200, 400. Referring now to FIGS. 24-35, a support tray may be connected to the force resisting structure 100, 200, 400. In one embodiment, as shown in FIGS. 24-30, a foldably constructed support tray 500 may be connected to the force resisting structure 100, 200, 400. In some embodiments, the support tray 500 may be connected to outer surfaces of the first member 102, 202, 402 (e.g., the support panel 108, 208, 408) and/or the second member 104, 204, 404 (e.g., the support wall 154, 254). Similar to the first and second members 102, 202, 402, 104, 204, 404 described above, the support tray 500 is produced from a flat blank of sheet material (e.g., a tray blank 502) that is foldably constructed or assembled (see FIGS. 29-30). As shown in FIGS. 29-30, the tray blank 502 may be formed monolithically as a single piece of sheet material made from a cellular material, such as corrugated paperboard (see FIGS. 9A and 9B and their associated description above). However, like the first and second blanks 128, 228, 130, 230 described above, the tray blank 502 may be made from substantially any type of deformable material, such as thermal plastics and ductile metals, with or without a cellular structure. The tray blank 502 may be formed in any suitable manner, such as by die or stamp cutting. In some embodiments, the tray blank 502 may be treated in various ways such that the tray blank 502 is moisture, water, fire, and/or bacteria resistant.

Prior to being foldably constructed or assembled, the support tray 500 is substantially flat or planar, as represented in FIGS. 29-30. When manufactured, the tray blank 502 includes a plurality of assembly features operable to facilitate assembly of the support tray 500. Similar to the first and second blanks 128, 228, 130, 230 described above, the tray blank 502 is manufactured with a plurality of fold lines, cut lines, tabs, and/or flanges operable to facilitate assembly and provide strength to the support tray 500, as described hereafter. As an example of an assembly feature, the tray blank 502 includes a plurality of foldable portions foldable along fold lines 504 in order to foldably construct the support tray 500. The tray blank 502 is provided, where necessary, with cut lines 506 creating separable edges to define the foldable portions and/or other structural elements of the support tray 500. The cut lines 506 may be configured similarly to the cut lines 142 of the first and second blanks 128, 228, 130, 230. In some embodiments, the fold lines 504 and/or the cut lines 506 may be defined or formed in the tray blank 502 during manufacturing, such as during die or stamp cutting.

Figure 24:
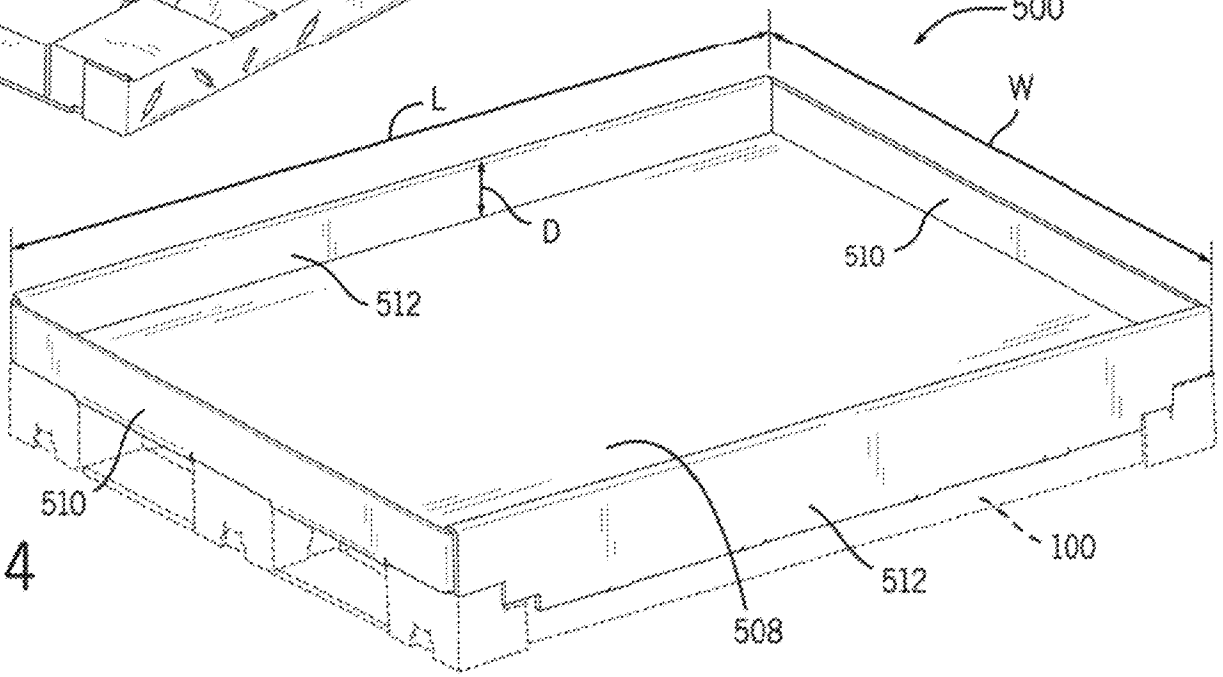
FIG. 24 is an isometric view of a support tray connected to a force-resisting structure in accordance with an embodiment of the present disclosure. The force-resisting structure is shown in dashed lines for clarity.
Figure 25:
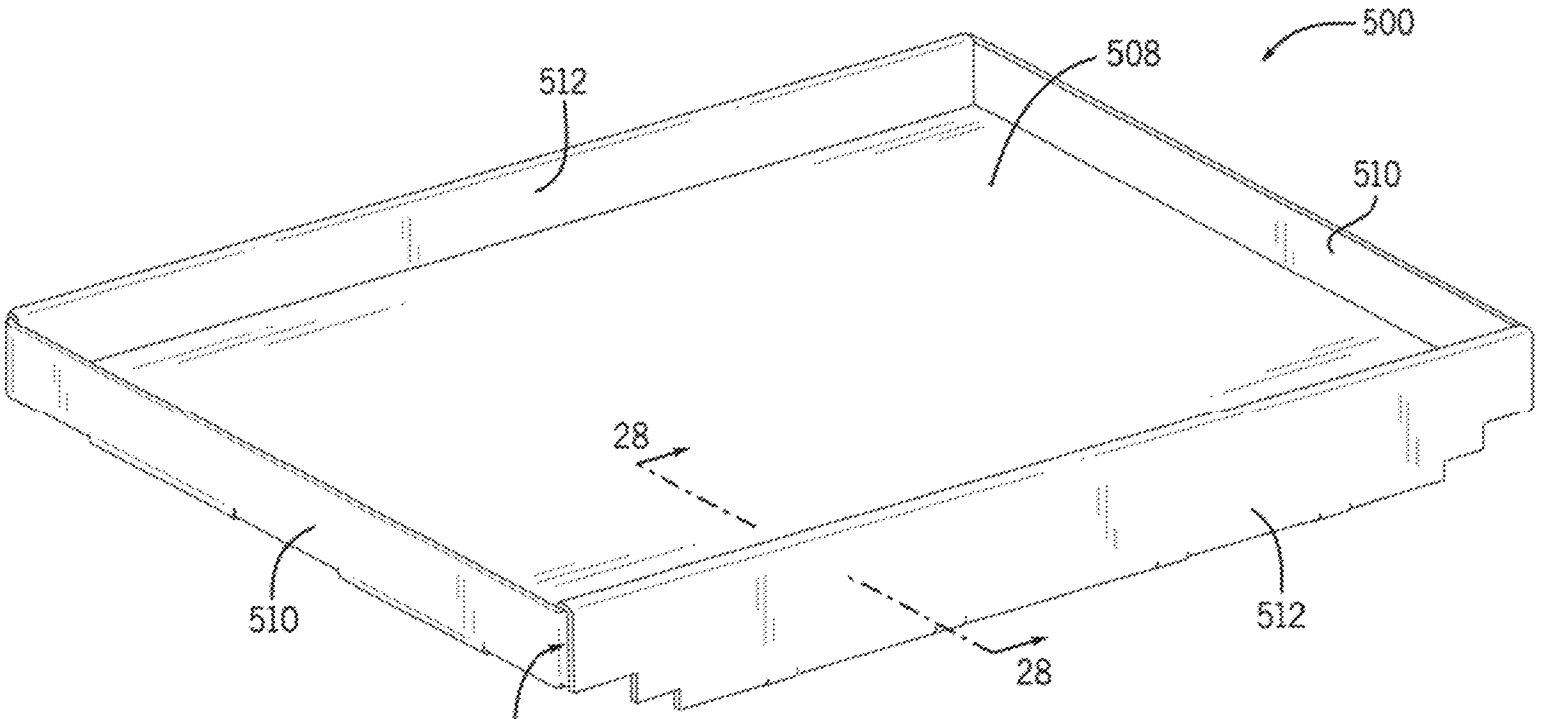
FIG. 25 is an isometric view of a support tray in accordance with an embodiment of the present disclosure.
Figure 26:
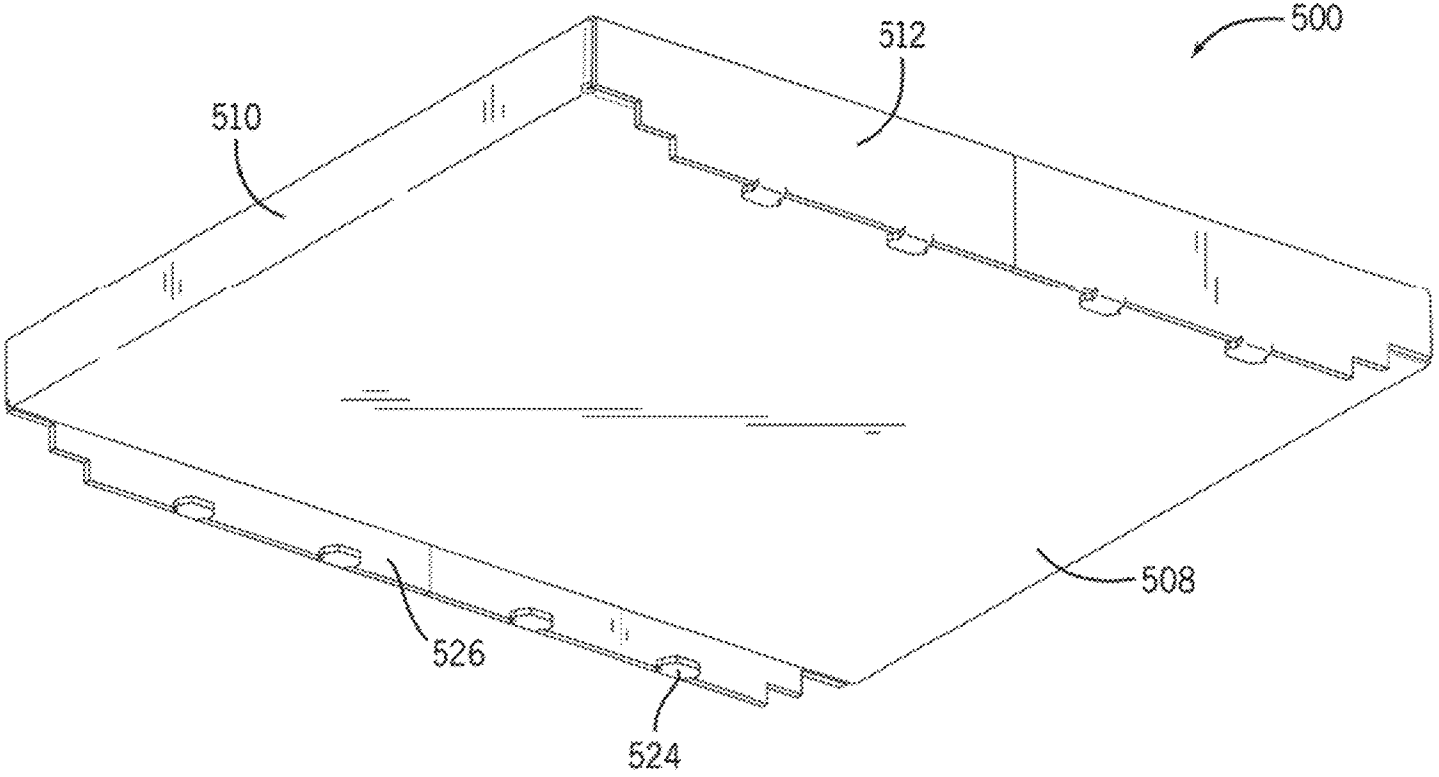
FIG. 26 is a bottom isometric view of the support tray of FIG. 25 in accordance with an embodiment of the present disclosure.
Figure 27:
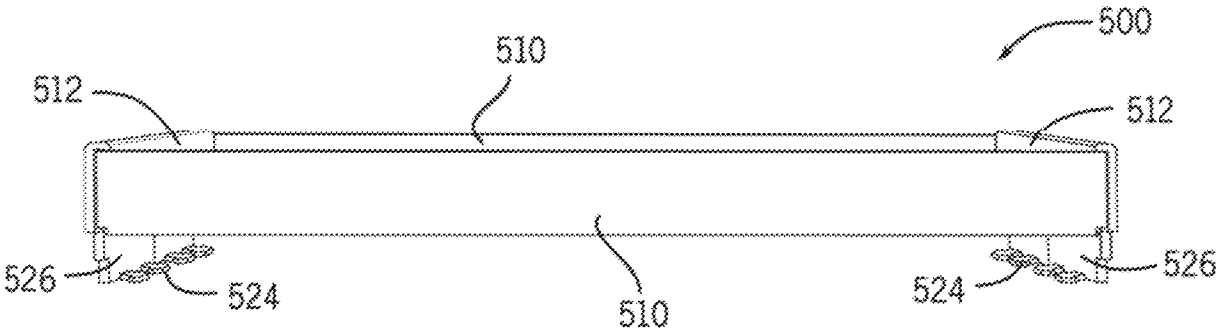
FIG. 27 is a perspective side elevation view of the support tray of FIG. 25 in accordance with an embodiment of the present disclosure.

With reference to FIG. 24, the support tray 500 includes a tray panel 508, a pair of opposing lips 510 foldably connected to the tray panel 508, and a pair of opposing securing sidewalls 512 foldably connected to the tray panel 508. As shown in FIG. 28, the securing sidewalls 512 may include a first wall section 514 foldably connected to the tray panel 508, and a second wall section 516 foldably connected to the first wall section 514. A portion of the lips 510 may be connected to the securing sidewalls 512 (e.g., the first and second wall sections 514, 516) when the support tray 500 is in an assembled or folded configuration. As shown in FIG. 24, once assembled or folded, the lips 510 and the securing sidewalls 512 may extend away from the tray panel 508 to define a cavity 518 having a length L, a width W, and a depth D. Each of the tray panel 508, the lips 510, and the securing sidewalls 512 may be sized such that the cavity 518 has the desired size and/or shape. For example, the tray panel 508, the lips 510, and the securing sidewalls 512 may be sized such that the depth D is greater than one or both of the width W and the length L, the depth is less than one or both of the width W and the length L, and/or the length L is equal to the width W. The support tray 500 may have dimensions corresponding to the dimensions of the force-resisting structure 100, 200, 400. For example, the tray panel 508 of the support tray 500 may be sized substantially equivalent to the support panel 108, 208, 408 of the first member 102, 202, 402. In this manner, the support tray 500 may be connected to the force-resisting structure 100, 200, 400 such that the lips 510 and the securing sidewalls 512 sit substantially flush with at least portions of the peripheral wall 112, 412.

Referring to FIGS. 25 and 28-30, in some embodiments, the support tray 500 may include a plurality of support flanges 520 foldably connected to the opposing lips 510. In an assembled or folded configuration, the support flanges 520 may be secured to the securing sidewalls 512. In some embodiments, the support flanges 520 may be secured within an opening 522 defined by each securing sidewall 512. For example, the support flanges 520 may be sandwiched between the first and second wall sections 514, 516 of the securing sidewalls 512 (see FIG. 28). Referring to FIG. 29, in some embodiments, the support tray 500 may include a plurality of securing tabs 524 foldably connected to the securing sidewalls 512 and operable to connect the support tray 500 to the force-resisting structure 100, 200, 400, as explained below. The securing tabs 524 of the support tray 500 are equivalent to the tabs 178, 278 of the first member 102, 202 and the tabs 178, 278 of the second member 104, 204 described above.

The support tray 500 is assembled by folding the first wall section 514 of each securing sidewall 512 away from the force-resisting structure 100, 200, 400 until the first wall section 514 is generally perpendicular to the tray panel 508. The opposing lips 510 are folded away from the force-resisting structure 100, 200, 400 until the opposing lips 510 are substantially perpendicular to the tray panel 508. The support flanges 520 of the opposing lips 510 are then folded inwardly until the support flanges 520 are substantially perpendicular to the opposing lips 510 and abut the first wall section 514 of each securing sidewall 512. The second wall section 516 of each securing sidewall 512 is then folded downwardly towards the force-resisting structure 100, 200, 400 and over the support flanges 520 of the opposing lips 510. The second wall sections 516 are folded over the support flanges 520 until the second wall sections 516 are generally parallel to the first wall section 514 and the support flanges 520. In this manner, the support flanges 520 are sandwiched between the first and second wall sections 514, 516 of the securing sidewalls 512. To secure the support tray 500 to the force-resisting structure 100, 200, 400, the support tray 500 is positioned adjacent a portion of the force-resisting structure 100, 200, 400 (e.g., positioned on top of the support panel 108, 208, 408 of the first member 102, 202, 402). In some embodiments, the securing sidewalls 512 may include a positioning portion 526 extending below the tray panel 508. In such embodiments, the positioning portion 526 may abut an upper portion of the support walls 154, 254, 454 to laterally locate the support tray 500 relative to the force-resisting structure 100, 200, 400. To further secure the support tray 500 to the force-resisting structure 100, 200, 400, the securing tabs 524 are folded inwardly and inserted within the tray slots 152 defined within the first wall panel 272A of each support wall 154, 254.

FIGS. 31-35 illustrate another embodiment of a support tray 600. The support tray 600 is substantially similar to the support tray 500 and its associated description above. In certain instances, descriptions of like features will not be discussed when they would be apparent to those with skill in the art in light of the description above and in view of FIGS. 31-35. For ease of reference, like structure is represented with appropriately incremented reference numbers.

Like the support tray 500, the support tray 600 may be constructed or assembled by folding and/or interlocking portions of the support tray 600 together. Once folded, the support tray 600 may be connected to the force resisting structure 100, 200, 400, such as connected to outer surfaces of the top member 102, 202, 402 and/or the bottom member 104, 204, 404. As described herein, the support tray 600 is produced from a flat blank or sheet material (e.g., corrugated paperboard or the like) that is foldably constructed or assembled into the final shape and structure. Like the support tray 500, the support tray 600 may be formed from any suitable material and in any suitable manner. To protect the support tray 600 from being damaged, the support tray 600 may be treated to be, for example, moisture, fire, and/or bacteria resistant.

Figure 33:
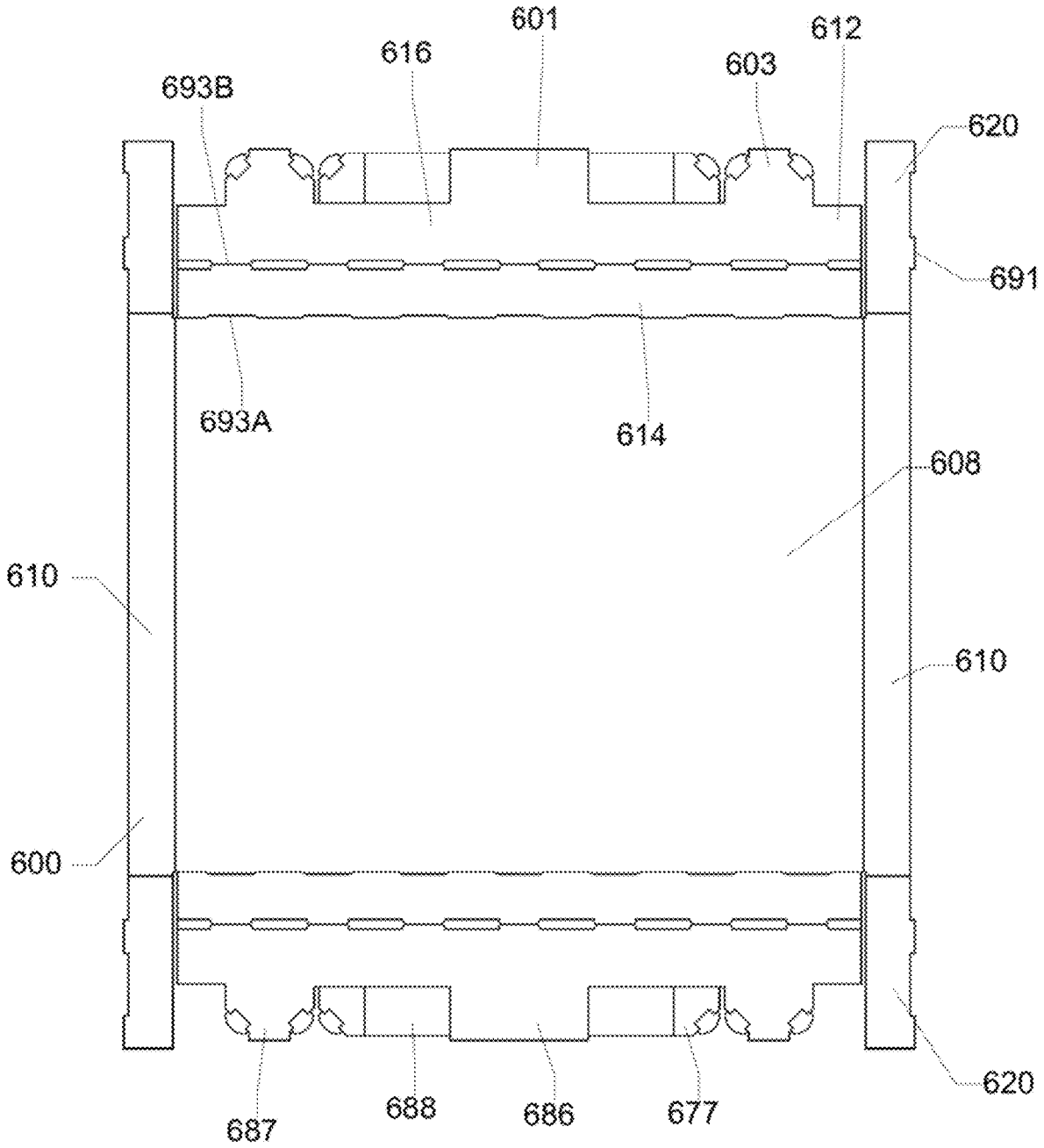
FIG. 33 is a top plan view of an additional tray blank in accordance with an embodiment of the present disclosure.
Figure 34:
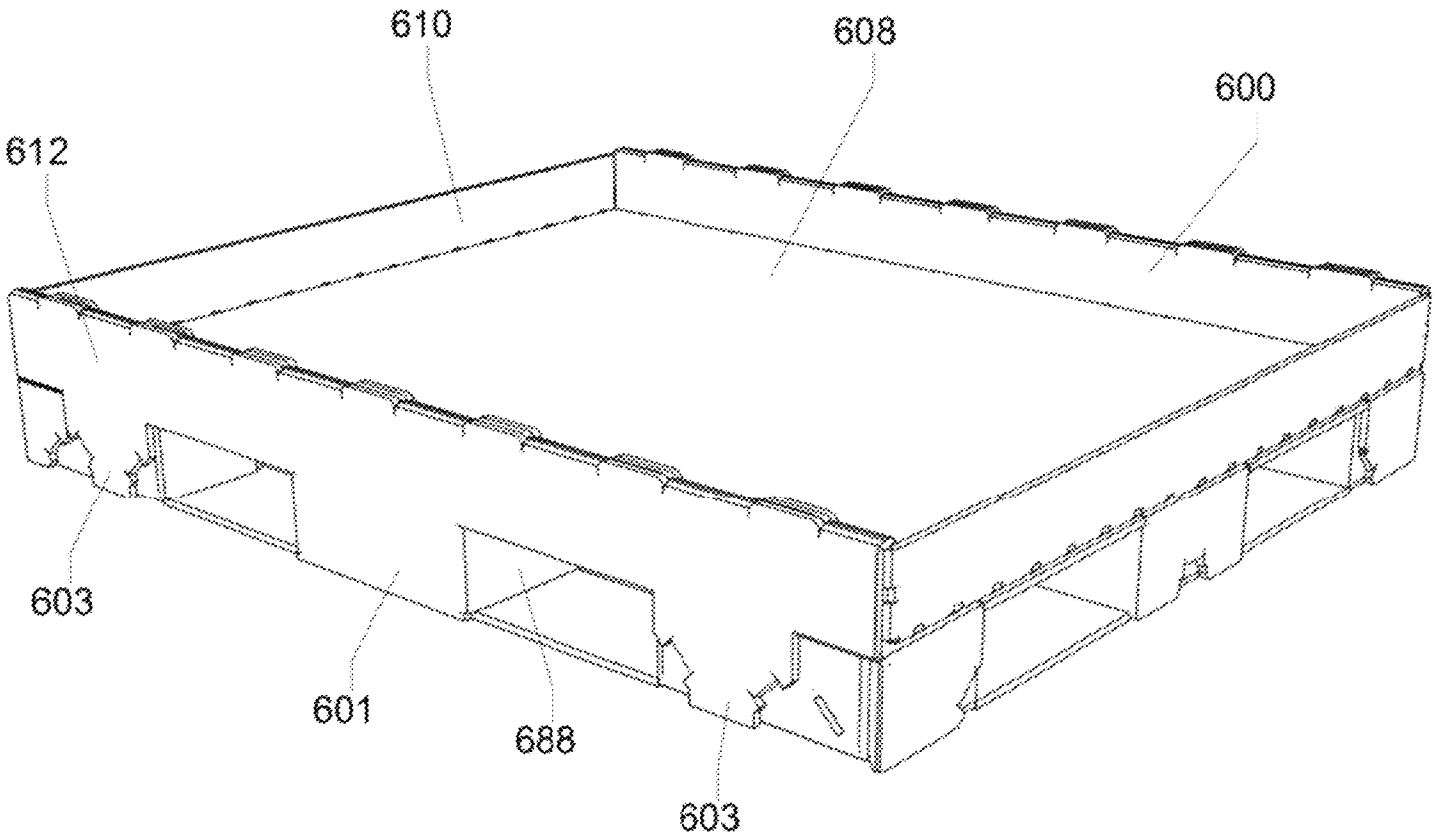
FIG. 34 is a top perspective view of the support tray of FIG. 31 connected to a pallet in accordance with an embodiment of the present disclosure.
Figure 35:
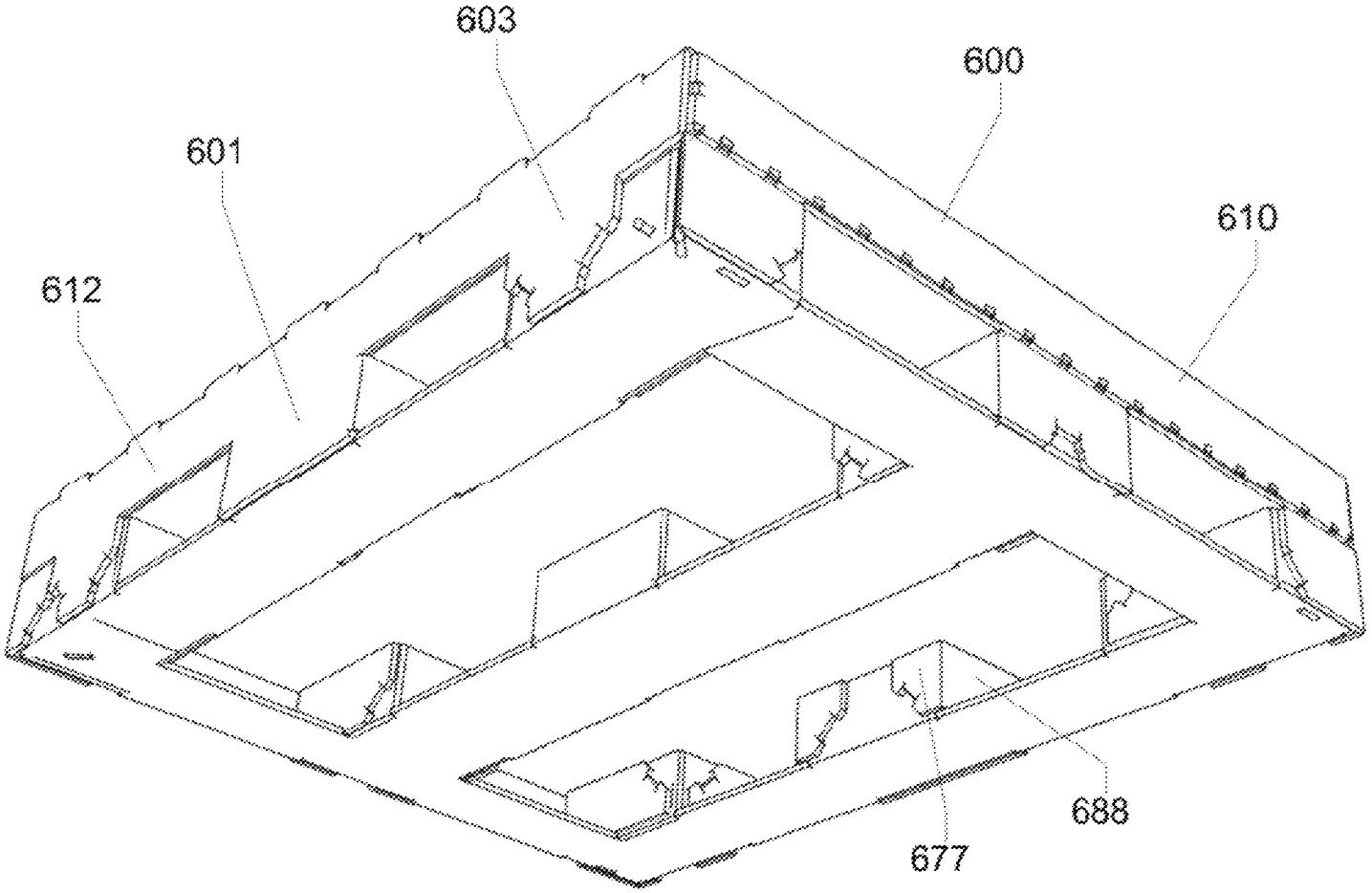
FIG. 35 is a bottom perspective of the support tray of FIG. 31 connected to a pallet in accordance with an embodiment of the present disclosure.

Prior to being foldably constructed, the support tray 600 is substantially flat or planar (see FIG. 33). Similar to the support tray 500, the support tray 600 includes a plurality of assembly features, such as fold lines, cut lines, tabs, and/or flanges, operable to facilitate assembly and to provide structural strength for the support tray 600. For instance, the support tray 600 includes a tray panel 608, a pair of opposing lips 610 foldably connected to opposing edges of the tray panel 608, and a pair of securing sidewalls 612 foldably connected to the remaining opposing edges of the tray panel 608. As shown, each sidewall 612 includes a first wall section 614 foldably connected to the tray panel 608, and a second wall section 616 foldably connected to the first wall section 614. In some embodiments, the intersection between the first wall section 614 and the tray panel 608 as well as the intersection between the first and second wall sections 614, 616 may include one or more slits 693A or cutouts 693B, respectively. In such embodiments, the slits 693A and cutouts 693B may provide locations of weakness to facilitate folding of the first and second wall sections 614, 616 into proper position. As explained below, the cutouts 693B may also receive at least a portion of the lips 610 therein to strengthen the support tray 600 in a folded configuration.

With reference to FIG. 33, each lip 610 may include one or more support flanges 620 extending from opposing sides of the lip 610. In an assembled or folded configuration, the support flanges 620 may be secured to the sidewalls 612. For example, the support flanges 620 may be sandwiched between portions of the first and second wall sections 614, 616. In some embodiments, each flange 620 may include one or more tabs 691 sized and shaped to be received within one or more cutouts 693B defined in the sidewalls 612 for the purposes mentioned above.

To secure the support tray 600 to the force resisting structure 100, 200, 400, the support tray 600 in one embodiment includes a plurality of connecting members extending from each second wall section 616. For instance, the support tray 600 may include a center connecting member 601 and a pair of outer connecting members 603 laterally spaced from the center connecting member 601. As shown, the outer connecting members 603 may be configured similarly to the first edge supports 484A of the force resisting structure 400. In particular, each outer connecting member 603 may include a support wall 687 with a plurality of tabs 678 (e.g., two tabs) rotatably coupled to the support wall 687. As explained below, the tabs 678 may be operable to secure the outer connecting members 603 to the force resisting structure 100, 200, 400, such as to the support structures defined along the perimeter of the force resisting structure 100, 200, 400.

With continued reference to FIG. 33, the center connecting members 601 may be configured similarly to the second edge supports 484B of the force resisting structure 400. For example, each center connecting member 601 may include a support wall 686 with a plurality of flaps 688 (e.g., two flaps) rotatably connected to the support wall 686. Each flap may include one or more tabs 678 rotatably coupled thereto, the tabs operable to connect the center connecting members 601 to the force-resisting structure 100, 200, 400, as explained below.

The support tray 600 is assembled by folding the lips 610 and the first wall section 614 of each sidewall 612 away from the force-resisting structure 100, 200, 400 until the lips 610 and first wall sections 614 are generally perpendicular to the tray panel 608. The flanges 620 may then be folded inwardly until the flanges 620 abut the first wall sections 614. The second wall sections 616 are then folded over the flanges 620 and towards the force resisting structure 100, 200, 400 until the second wall sections 616 abut the flanges 620 and extend substantially parallel to the first wall sections 614. To secure the support tray 600 to the force-resisting structure 100, 200, 400, the support tray 600 is positioned on top of the support panel 108, 208, 408 of the force resisting structure 100, 200, 400, at which point the connecting members are secured to the force resisting structure 100, 200, 400. For instance, the tabs 678 of the outer connecting members 603 may be folded inwardly and inserted within corresponding apertures (e.g., the tray slots 152) defined within a portion of the force resisting structure 100, 200, 400 (e.g., within the supports 154, 254, 454). Additionally or alternatively, the flaps 688 of the center connecting members 601 may be folded inwardly within the fork passages 106, 206, 406 at which point the tabs 678 of the center connecting members 601 may be secured to internal portions of the force resisting structure 100, 200, 400. In embodiments wherein fork passages 106, 206, 406 are defined within each side of the force resisting structure 100, 200, 400, the center connecting members 601 may include secondary flaps 677 rotatably connected to the flaps 688. In such embodiments, the secondary flaps 677 may be folded relative the flaps 688 such that the center connecting members 601 substantially surround an internal support structure of the pallet 100, 200, 400 (see FIG. 35).

The foregoing description has broad application. While the provided embodiments describe a force-resisting structure especially suited for use as a pallet, it should be appreciated that the concepts disclosed herein may equally apply to many types of force-resisting structures, including dunnage supports, display stands, furniture, and other structural foundations or supports, whether movable or non-movable. Moreover, while the provided embodiments describe components of a force-resisting structure being secured together through corresponding tabs and slots, the components described above may be secured together using adhesive, glue, fasteners, or other suitable connection mechanisms. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation.

The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A foldably constructed support tray configured to be attached to a foldably constructed pallet, the tray comprising:

a tray panel;

a pair of opposing lips foldably connected to the tray panel;

a plurality of support flanges foldably connected to the pair of opposing lips; and a pair of opposing securing sidewalls foldably connected to the tray panel;

wherein the plurality of support flanges are coupled to the pair of securing sidewalls to form corners of the foldably constructed support tray;

wherein the pair of securing sidewalls includes a plurality of securing tabs for securing the tray to the foldably constructed pallet.

2. The foldably constructed support tray of claim 1, wherein the support flanges are received within openings defined by the securing sidewalls.

3. The foldably constructed support tray of claim 1, wherein the support flanges are sandwiched between first and second wall sections of each securing sidewall.

4. The foldably constructed support tray of claim 1, wherein in a folded configuration, a portion of the pair of securing sidewalls extends below the tray panel.

5. The foldably constructed support tray of claim 1, wherein the pair of securing sidewalls includes a center connecting member and a pair of outer connecting members laterally spaced from the center connecting member.

6. The foldably constructed support tray of claim 5, wherein the pair of outer connecting members includes a plurality of securing tabs.

7. The foldably constructed support tray of claim 1, wherein the tray panel, the pair of opposing lips, and the pair of opposing securing sidewalls define a cavity having a length, a width, and a depth.

8. The foldably constructed support tray of claim 7, wherein the depth is greater than at least one of the width and the length.

9. The foldably constructed support tray of claim 7, wherein the depth is less than at least one of the width and the length.

10. The foldably constructed support tray of claim 7, wherein the length is equal to the width.

11. A force resisting structure comprising:

a foldable pallet comprising:

a top member having a support surface and a first portion foldably connected to the support surface, a bottom member connected to the top member, the bottom member having a base and a second portion foldably connected to the base, and a peripheral wall extending between the support surface and the base, the peripheral wall defined at least partially by the first portion of the top member and the second portion of the bottom member; and a foldable support tray coupled to the foldable pallet, the foldable support tray comprising:

a tray panel, a pair of opposing lips foldably connected to the tray panel, and a pair of securing sidewalls foldably connected to the tray panel, wherein portions of each lip are secured to each securing sidewall;

wherein the tray panel is positioned above the support surface.

12. The force resisting structure of claim 11, wherein the pair of securing sidewalls have a plurality of securing tabs, wherein the plurality of securing tabs are received within a plurality of slots defined within the second portion of the bottom member.

13. The force resisting structure of claim 11, wherein a portion of the foldable support tray extends within an interior of the foldable pallet.

14. The force resisting structure of claim 13, wherein the portion of the foldable support tray extends within fork passages defined within the peripheral wall.

15. The force resisting structure of claim 11, wherein each securing sidewall of the pair of securing sidewalls has a pair of outer connecting members, the pair of outer connecting members including a plurality of tabs, wherein the plurality of tabs are received within a plurality of tray slots defined within the peripheral wall.

16. The force resisting structure of claim 11, wherein the tray panel is substantially the same size as the support surface.

17. The force resisting structure of claim 11, wherein the pair of opposing lips and the pair of opposing securing sidewalls are substantially flush with at least portions of the peripheral wall.

18. A foldably constructed support tray configured to be attached to a foldably constructed pallet, the tray comprising:

a tray panel with first and second opposing edges;

a pair of opposing lips foldably connected to the first opposing edges of the tray panel; and a pair of opposing sidewalls foldably connected to the second opposing edges of the tray panel;

wherein the opposing sidewalls include an outer connecting member extending downwardly therefrom to a position below a bottom surface of the tray panel;

wherein the outer connecting member couples the tray panel to the foldably constructed pallet when the support tray is attached to the foldably constructed pallet.

19. The foldably constructed support tray of claim 18, wherein the outer connecting member includes a plurality of tabs, wherein the plurality of tabs are received within a plurality of tray slots defined within the foldably constructed pallet.

20. A foldable support assembly comprising:

a foldably constructible pallet in a first unfolded state, the foldably constructible pallet comprising:

a first blank comprising a first predefined line of weakness, the first predefined line of weakness defining a foldable connection between a support panel and a first portion, wherein the first blank is substantially flat in the first unfolded state, and the first blank forms a first member of the foldably constructible pallet when the first portion is folded relative to the support panel, and a second blank comprising a second predefined line of weakness, the second predefined line of weakness defining a foldable connection between a base panel and a second portion, wherein the second blank is substantially flat in the first unfolded state, the second blank forms a second member of the foldably constructible pallet when the second portion is folded relative to the base panel, and the second member is coupled to the first member when the foldably constructible pallet is in a first folded state; and a foldably constructible support tray in a second unfolded state, the foldably constructible support tray comprising:

a tray blank comprising predefined locations of weakness, wherein the predefined locations of weakness define a foldable connection between:

a tray panel and a pair of opposing sidewalls, and the tray panel and a pair of opposing lips, wherein portions of each lip secure to each sidewall when the tray blank is in a second folded state;

wherein the first and second unfolded states create a reduced volume for transportation.

* * * * *